United States Patent [19]

Smith et al.

[11] Patent Number: 4,498,650

[45] Date of Patent: Feb. 12, 1985

[54] MICROPROCESSOR BASED TRACK CIRCUIT FOR OCCUPANCY DETECTION AND BIDIRECTIONAL CODE COMMUNICATION

[75] Inventors: Barry L. Smith; James R. Hoelscher; William A. Petit, all of Rochester, N.Y.

[73] Assignee: General Signal Corporation, Stamford, Conn.

[21] Appl. No.: 356,861

[22] Filed: Mar. 10, 1982

[51] Int. Cl.[3] ..... B61L 25/00; B61L 21/00

[52] U.S. Cl. ..... 246/122 R; 246/34 R; 246/34 A

[58] Field of Search ..... 246/122 R, 34 R, 34 A, 246/28 F, 125, 128, 130, 249

[56] References Cited

U.S. PATENT DOCUMENTS

| | | | |
|---|---|---|---|
| 3,359,416 | 12/1967 | Wilcox | 246/122 R |
| 3,641,338 | 2/1972 | Peel | 246/122 R |
| 4,107,253 | 8/1978 | Borg | 246/182 B |
| 4,179,744 | 12/1979 | Lowe | 246/122 R |
| 4,181,849 | 1/1980 | Sibley | 364/900 |
| 4,365,777 | 12/1982 | Geiger | 246/130 |
| 4,369,942 | 1/1983 | Wilson | 246/34 R |

OTHER PUBLICATIONS

"Elements of Railway Signalling", General Railway Signal, Jun. 1979, pp. 2, 416–429.

"Safety Assurance Logic–Using Microprocessors Vitally", Sibley, General Railway Signal Co., Oct. 81.

*Proceedings of the IEEE,* Parasuraman, Jun. 1976, pp. 851–894.

*Primary Examiner*—James J. Groody

*Attorney, Agent, or Firm*—Pollock, Vande Sande & Priddy

[57] ABSTRACT

A railroad train detector and communication system relies on the track rails for communicating information among a plurality of locations. The equipment located at each of the locations eliminates relay based current detection, relay based current transmission, and relay based logic functions, and rather these functions are implemented with microprocessors. An extent of signal trackway is defined between a pair of head ends, intermediate the head ends at intermediate insulated joint locations, a microprocessor implemented transmitter/-receiver pair is provided. One half of the transmitter/-receiver pair manages communication flow for each direction of information flow at the joint. At each of the head locations, only a single transmitter/receiver is required. Associated with each microprocessor in a transmitter/receiver is auxiliary apparatus to couple the microprocessor's input/output ports to the track rails themselves. This auxiliary apparatus includes non-relay based track signal detector (or receiver) for sensing current flow in the track rails, a track current generator for transmitting information through the track rails and optionally a non-relay based approach detector to sense changes in track current flow. Based on signals detected in the track rail, the microprocessor of a receiver for example can determine the occupancy condition of a portion of the railroad track rails between the receiver and associated transmitter. Based on the signals, therefore, the microprocessor outputs an indication identifying the occupancy/non-occupancy condition of this portion of the track rails.

23 Claims, 24 Drawing Figures

RELAY DRIVER

BI-POLAR SIGNAL MECHANISM DRIVER

EXEC

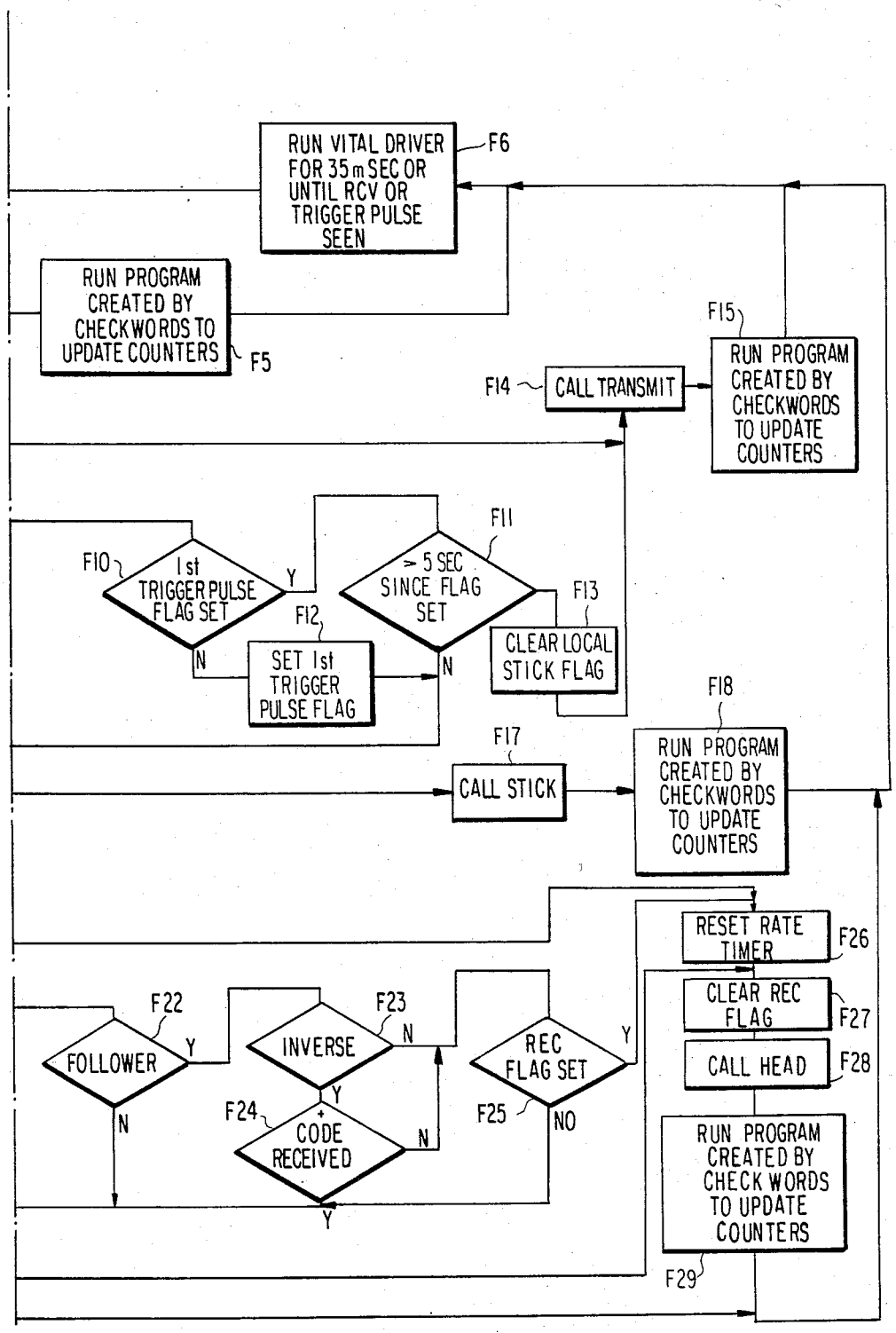
RUN VITAL DRIVER FOR 35 m SEC OR UNTIL RCV OR TRIGGER PULSE SEEN
F6
RUN PROGRAM CREATED BY CHECKWORDS TO UPDATE COUNTERS
F5
F15
RUN PROGRAM CREATED BY CHECKWORDS TO UPDATE COUNTERS
F14
CALL TRANSMIT
F10
1st TRIGGER PULSE FLAG SET
Y
N
F11
> 5 SEC SINCE FLAG SET
F12
SET 1st TRIGGER PULSE FLAG
F13
CLEAR LOCAL STICK FLAG
F18
F17
CALL STICK
RUN PROGRAM CREATED BY CHECKWORDS TO UPDATE COUNTERS
RESET RATE TIMER
F26
CLEAR REC FLAG
F27
CALL HEAD
F28
F22
FOLLOWER
F23
INVERSE
F24
+ CODE RECEIVED
REC FLAG SET
F25
NO
RUN PROGRAM CREATED BY CHECK WORDS TO UPDATE COUNTERS
F29

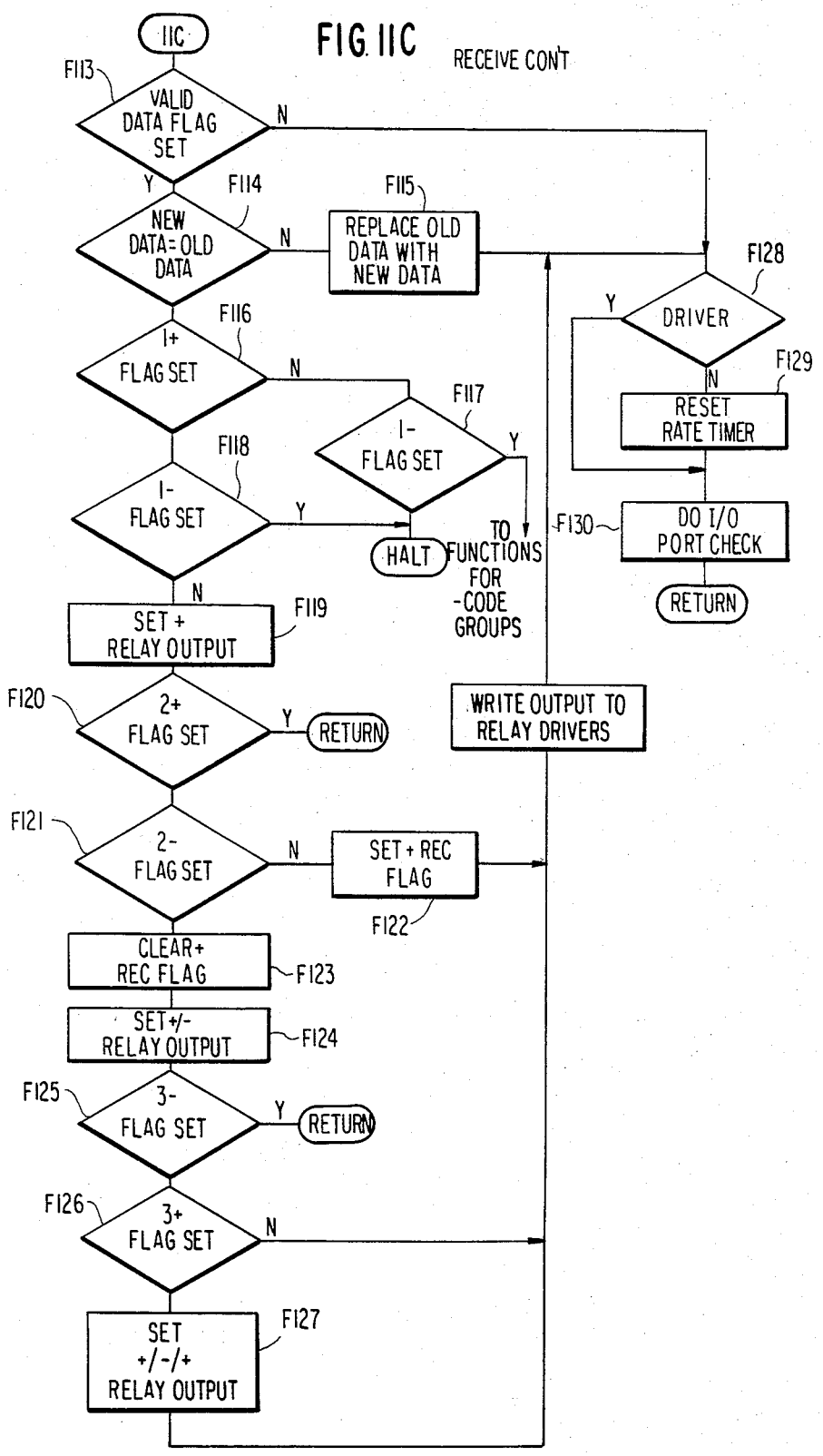
FIG. 11C
RECEIVE CONT
11C
F113
VALID DATA FLAG SET
N
Y
F114
NEW DATA=OLD DATA
N
F115
REPLACE OLD DATA WITH NEW DATA
F116
1+ FLAG SET
N
F117
1- FLAG SET
Y
F118
1- FLAG SET
Y
HALT
TO FUNCTIONS FOR -CODE GROUPS
N
F119
SET + RELAY OUTPUT
F120
2+ FLAG SET
Y
RETURN
F121
2- FLAG SET
N
SET + REC FLAG
F122
CLEAR+ REC FLAG
F123
SET+/- RELAY OUTPUT
F124
F125
3- FLAG SET
Y
RETURN
F126
3+ FLAG SET
N
F127
SET +/-/+ RELAY OUTPUT
WRITE OUTPUT TO RELAY DRIVERS
F128
DRIVER
Y
N
F129
RESET RATE TIMER
F130
DO I/O PORT CHECK
RETURN

HEAD

STICK

STICK CONT'D

VITAL DRIVER

MICROPROCESSOR BASED TRACK CIRCUIT FOR OCCUPANCY DETECTION AND BIDIRECTIONAL CODE COMMUNICATION

DESCRIPTION

1. Field of the Invention

The present invention relates to railroad signaling and more particularly to bidirectional coded track circuits.

2. Background of the Invention

The track circuit is the basic technique used for detecting train location in a section of track. The coded track circuit is an improvement which, without interfering with the occupancy detection function, allows the transmission of information either to the vehicle itself or to other wayside apparatus for purposes such as signal control. The application of the track circuit or the coded track circuit for single direction running (that is, where vehicles always proceed in one and not the other direction) is relatively straight forward. For double direction running, duplicated equipment is usually required to ensure that the vehicle is always travelling toward a code transmitter. In some signal systems the track rails are paralleled by signal lines, on which signalling information is carried to repeat vehicle position information from one track section to the next.

A relay based system for eliminating the line wires, even for cases of double direction running, has been introduced and is now in use. This system, referred to as TRAKODE by the General Railway Signal Company, is described, beginning at page 416, in "Elements of Railway Signalling" published by General Railway Signal (Rochester, N.Y., 1979). In TRAKODE the controlled territory is divided into a number of track sections by insulating the rails. Wayside equipment is located adjacent the locations of track insulation. These locations are defined as a head (there are two heads in each controlled territory) or an intermediate. One head (the driver) is identified as the master, and it initiates communication by transmitting a coded message down the rails toward the adjacent intermediate. The intermediate, when it receives coded information, can pass it along to the next adjacent intermediate, and in this fashion the coded information travels from one head to the other head (follower). At the follower, the flow of information is reversed, and information is transmitted back toward the head (driver). The presence of a vehicle, somewhere between one head and the other will obviously terminate this communication flow due to the short circuit occasioned by the vehicle's presence, and it is this termination of communication which is used to detect occupancy. Although the follower normally transmits information after receiving it from a driver, in the absence of reception it will independently transmit information toward the driver. The presence of a vehicle somewhere between the driver and the follower will terminate information flow from both the driver and the follower at the track section in which the vehicle is located. This is used to determine the vehicle location to within a single track section. TRAKODE also includes the use of approach detection and a stick function to provide signalling behind a vehicle directed in a direction opposite the direction in which the vehicle is travelling. This provides signalling for other vehicles behind a vehicle travelling in the same direction as the vehicle. Apparatus at an intermediate, in detecting a vehicle approach, is conditioned so that when information flow is terminated in the adjacent track section, it is allowed to initiate transmission behind the vehicle opposite the direction in which the vehicle is travelling. Similarly, because the vehicle also terminates the information flow forward of the vehicle in the direction in which the vehicle is travelling, inverse coding (that is transmission ahead of the vehicle) may be provided.

All of the equipment described above works quite well, however it is desired to improve the equipment for a number of reasons. Firstly, as a review of the referenced material will indicate the equipment is relatively complex, and in addition, must be almost custom designed. For example, the wayside equipment at the head ends is quite different from the wayside equipment at intermediate locations, the functions which can be included result in a very flexible system which must, however, be carefully planned and layed out. Electromagnetic relays are used almost exclusively for system logic, signal timing, etc. These relays are a maintenance burden, require undue amounts of space in comparison to modern IC equipment. The philosophy of this system requires, for example at intermediate locations, the repeating of a received pulse in the form of a transmitted pulse. Since the length of the rails between pairs of insulated joints can be relatively long (thousands of feet) and since there may be many sections within a controlled territory, the pulse timing may well degrade to the detriment of the system timing. Furthermore, the very use of relays requires a maintenance effort, and it is desired to reduce this required maintenance effort by eliminating the relays all together.

Accordingly, it is an object of the invention to provide an apparatus which will serve to detect the occupany of a track section in a manner which is at least as reliable as the referred to TRAKODE (and other similar) system but which at the same time does not require the maintenance level required of relay logic and timing. It is another object of the present invention to provide for an occupancy detection and bidirectional signalling system which does not require the use of line wires and also does away with the use of relays for current detection and signal generation. It is a further object of the present invention to provide a system which meets the foregoing objects and which at the same time does not rely upon relay implemented logic functions. It is simultaneously an object of the invention to meet the foregoing stated objects of the invention with equipment which is nominally identical regardless of whether the equipment is to be located at an intermediate insulated joint in a controlled territory or at one of the ends of the controlled territory.

In meeting these and other objects of the invention, a train occupancy and bidirectional information transmission system is disclosed in which information is transmitted within the track rails themselves, and in which relay based current detection, relay based current transmission and relay based logic functions are eliminated in favor of a microprocessor implementation.

In accordance with the invention, a microprocessor implemented transmitter/receiver pair is provided at each intermediate insulated joint location, one half of the transmitter/receiver pair manages the communication flow for each direction of information flow at the insulated joint. Accordingly, only a single transmitter/receiver is required at each of the ends (heads) of the controlled territory. Associated with each microprocessor in a transmitter/receiver, is auxiliary apparatus which couples the microprocessor's input/output ports to the track rails themselves. This auxiliary apparatus includes a non-relay based track signal detector (or receiver), i.e. equipment to sense current flow in the track rails coupled to a microprocessor input port, a track current generator for transmitting information through the track rails coupled to a microprocessor output port, an optional non-relay based approach detector to sense changes in track current flow also coupled to a microprocessor input port. Since the polarity of current flow in the rails is used to encode information, the receiver is capable of distinguishing the two polarities of track current flow and the track current generator includes both positive and negative pulse generators to generate both polarities of current for transmission in the track rails. At an intermediate location, the microprocessor of one transmitter/receiver is also directly coupled to the microprocessor of the adjacent transmitter/receiver for the purpose of transferring information received over the track rails at one microprocessor to the adjacent microprocessor for the generation of information to be transmitted within the next track section.

Each microprocessor includes apparatus to respond to receipt of encoded information to select the code group output, additional apparatus to respond to the selection of a code group output to identify the code group output to the microprocessor associated with the adjacent transmitter/receiver, and apparatus responsive to the identification of a code group by the other transmitter/receiver to stimulate the associated generator to transmit a corresponding code group. Continued reception of a code group at a particular transmitter/-receiver, that is repeated receptions of a code group within a predetermined time period, enables a lack of occupancy output. A microprocessor associated with the heads further includes a timer function for timing out a predetermined period and additional apparatus responsive to the expiration of the timing period for also stimulating the associated pulse generators to transmit a predetermined code group. To maintain orderly information flow within the controlled territory, the microprocessors at the ends are personalized to identify whether they are to normally independently transmit or only to dependently transmit. In the former case, the predetermined time in the timer is selected to be shorter than the predetermined period of the latter. Accordingly, in the absence of train occupancy, the head with the shorter predetermined time period, normally transmits to the other head (follower) before the expiration of the timer at the follower, and thereby dependent transmission is maintained at the other (follower) head.

Accordingly, in one aspect, the invention provides a railroad track circuit comprising a transmitter and a receiver spaced apart along a section of railroad track, in which the transmitter comprises:

a source of electrical energy and means coupling said source of electrical energy to said section of railroad track, and in which said receiver comprises:

microprocessor means with at least one input port and at least one output port, means connecting said input port to said section of track at a location spaced from said means coupling said source of electrical energy, output means for driving an indication device coupled to said output port and including means responsive to signals received at said input port, whereby said output means is capable of controlling an indication device to indicate the occupancy condition of said section of track between said transmitter and receiver.

In accordance with another aspect, the invention provides an occupancy detection and communication system for railroads which eliminates the necessity for signalling line wires running parallel to a section of track, comprising:

a plurality of transmitter/receiver pairs, each pair located at a different one of a plurality of insulated joints in a railroad territory, and a single transmitter/-receiver located at each end of said railroad territory, each said transmitter/receiver comprising:

a microprocessor with plural input and output ports, a pair of pulse generators of different polarity coupled between different output ports and said track adjacent the transmitter/receiver, a receiver coupled between an input port and said track adjacent a transmitter/receiver, said microprocessor including:

first means responsive to receipt of one or more pulses in a code group to select a code group output, second means responsive to selection of a code group output to identify said code group output to the other transmitter/receiver of said pair, third means responsive to identification of a code group output by the other of said transmitter/receiver pair to stimulate said pulse generators to transmit a corresponding code group, and driver means responsive to said first means for maintaining a lack of occupancy output only so long as said first means selects a pulse group output within a predetermined timing period.

In accordance with this aspect of the invention, the microprocessors in the single transmitter/receiver each include:

timing means for timing out a predetermined period, and fourth means responsive to expiration of said timing means for stimulating said pulse generators to transmit a predetermined code group.

The microprocessors in each single transmitter/-receiver further includes:

personality means to identify whether said transmitter/-receiver is at one or another end of said track territory to indicate whether or not independent coding is allowed, driver means responsive to said personality means is allowed, to provide a code group selection to said second means, and wherein said timing means determines a first or second predetermined period depending on whether or not said transmitter/receiver is at one or another end of said track territory.

BRIEF DESCRIPTION OF THE DRAWINGS

The invention will be more particularly described in the following portions of the specification when taken in conjunction with the attached drawings in which like reference characters identify identical apparatus and in which:

FIGS. 9A-9B (EXEC); 10A-10B (TRANSMIT); 11A-11C (RECEIVE); 12 (HEAD); 13A-13B (STICK); 14 (VITAL DRIVER) and 15 (RCU TST) are flow diagrams of software provided by CPU 25 of FIG. 3.

DETAILED DESCRIPTION OF PREFERRED EMBODIMENTS

Figure 1:
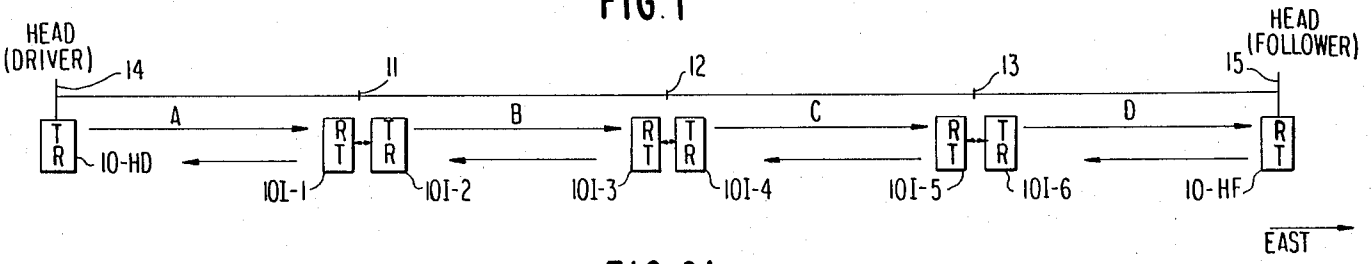
FIG. 1 is a block diagram of a controlled section of track illustrating the distribution of wayside equipment in accordance with the invention relative to insulated joints in the track itself.

FIG. 1 illustrates a controlled track territory located between insulated joints 14 and 15, and including a section A located between insulated joint 14 and 11, section B between insulated joints 11 and 12, section C between insulated joints 12 and 13 and section D between insulated joints 13 and 15. As shown in FIG. 1, the wayside equipment includes a plurality of transmitter/receivers 10 including pairs of transmitter/receivers located adjacent insulated joints 11, 12 and 13, and a single transmitter/receiver at each head end, associated with insulated joints 14 and 15. Transmitter/receiver (T/R) 10-HD is nominally the driver and head transmitter/receiver 10-HF is nominally the follower.

In normal operation, a signal is generated at T/R 10-HD and transmitted in an eastward direction through section A where it is received at T/R 10-I1. Receipt of this information results in an information transfer process from T/R 10-I1 directly to T/R 10-I2, and the subsequent transmission of information also in an eastward direction in track section B. The information is received at T/R 10-I3 associated with the insulated joint 12 and transferred to the T/R 10I-4 in the same fashion. This results in propagation of a signal in track section C, also in an eastward direction. Similar action occurs at the T/R pair associated with the insulated joint 13, so that after a time delay information is received at the follower T/R 10-HF. Receipt of the information at that point initiates transmission of information in the westward direction through track section D. Similar information transfers result in the receipt of information at the T/R 10-HD. In the foregoing description, the information transmission through each section is accomplished via applying current pulses to the track rails themselves. These current pulse(s) are detected, in a manner to be explained at a T/R, and normally that detection results in the transmission of a current pulse(s) in an adjacent track section, or in the case of the head (follower), receipt of a current pulse(s) results in transmission of a current pulse(s) in the same section of track, but in the opposite direction. The current pulse(s) itself may either be DC or a chopped carrier, although typically the current pulse(s) is direct current.

Furthermore, the information transfer is not restricted to a simple pulse or no pulse, but rather pulse combinations can be and are employed, of negative and positive polarity. Typically the information transferred is encoded in from one to three pulses, with adjacent pulses of opposite polarity.

Figure 2A:
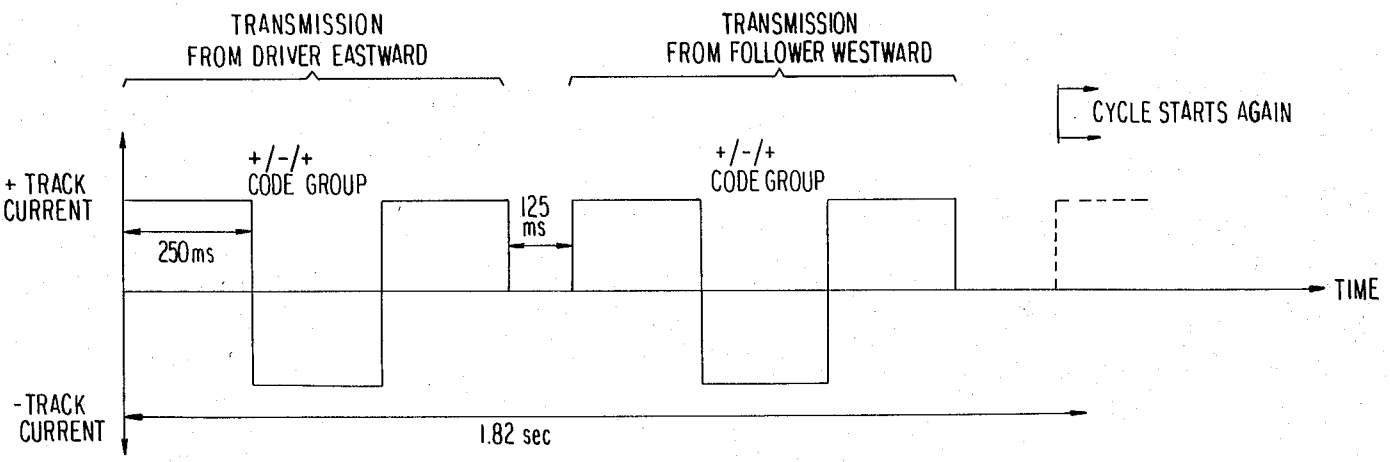
FIGS. 2A and 2B illustrate, respectively, the transmission of information encoded in the form of the polarity of current in the track rails from one end of the controlled section to the other and back again via two different exemplary code groups.
Figure 2B:
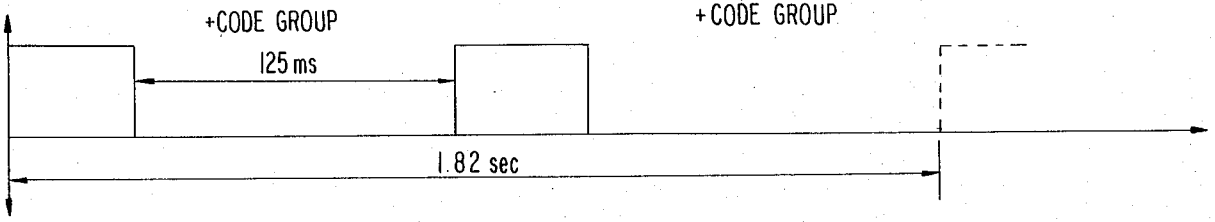

FIGS. 2A and 2B represent examples of the current pulses in the track rails for two different code groups. As is shown in FIG. 2A, an eastbound pulse group is made up of three pulses, each 250 milliseconds in duration. Based on the polarity of the pulse group, it can be identified as a +/−/+ code group. By reason of the dependent coding and delay between the transmission of a first eastbound code group and the second (for the embodiment of FIG. 2A a complete cycle, that is the period between the beginning of a first eastbound code group and the second is 1.82 seconds) the westbound code group, in any section of track, follows the end of the eastbound code group by about 125 milliseconds. These parameters allow the inventive apparatus to interface with the relay TRAKODE. If that is not necessary, these parameters can be varied within wide limits. Although FIG. 2A shows that the westbound code group can also be characterized +/−/+, it should be understood that that is not at all essential to the invention. That is, the code group need not be identical from section to section. Indeed, the same information can be encoded differently in each track section, if desired.

FIG. 2B shows a different code group comprising only a single + pulse; note in the case of FIG. 2B that the beginning of the westbound code group occurs at the same time relative to the beginning of the eastbound code group as does the code group in FIG. 2A. More specifically, the delay between the beginning of eastbound and westbound code groups remains unchanged regardless of whether or not the code group has one, two or three pulses. Likewise, the same 1.82 second delay between transmission cycles is implemented. Furthermore, the 125 ms delay can be changed as desirable or necessary. The signalling current in the rails can be used for signalling to a vehicle, wayside signalling, approach lighting of signals, etc.

With the information flow established in the control territory of FIG. 1, as described above, a train entering section A and travelling eastward produces a number of results. The presence of the train in track section A prevents communication between T/R 10-HD and the T/R pair at insulated joint 11. This loss of communication is used to signal the section occupancy. As will be explained, an inverse function can be performed at the T/R pair at insulated joint 11 so that the eastbound transmission from insulated joint 11 to 15 is maintained, notwithstanding the fact that the transmission from T/R 10-HD is interrupted. This inverse transmission is only of non-signal clearing codes. In this fashion opposing signals are maintained red but block signalling is still supported. Likewise, the westbound communication is maintained so that the westbound signalling from the T/R pair at insulated joint 11 can be used to clear signals ahead of the eastbound vehicle in section A.

As the vehicle moves into section B, the communication between the T/R pairs at insulated joints 11 and 12 is interrupted. A further inverse function may be performed at the T/R pair at insulated joint 12 to maintain eastbound and westbound communication between joints 12 and 15. This also maintains the westbound communication toward the vehicle now in section B. As the vehicle leaves section A, communication can now be reestablished between equipment located at insulated joints 14 and 11 via a stick function.

Figure 3:
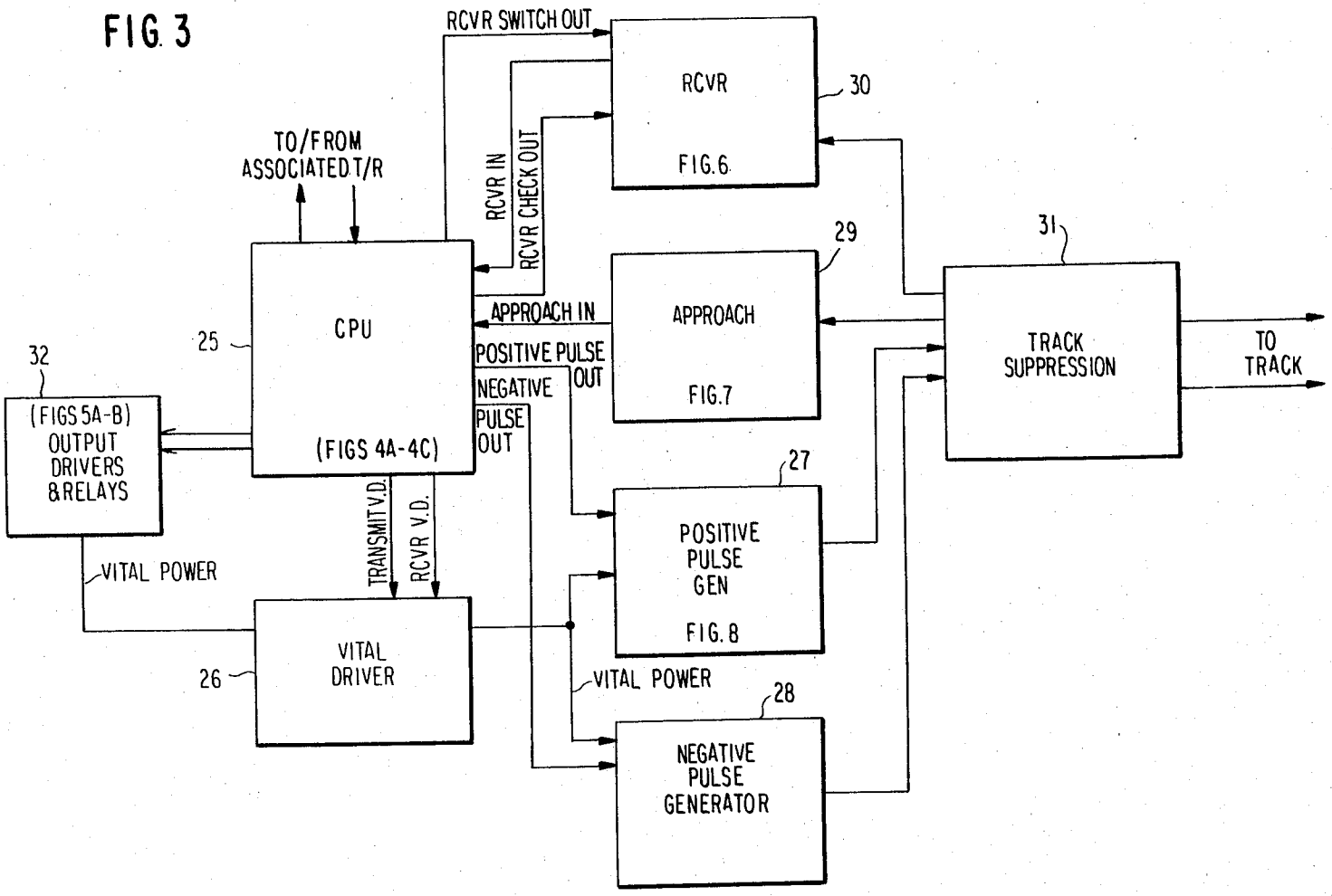
FIG. 3 is a block diagram of a transmitter/receiver 10.

Reference is now made to FIG. 3 which illustrates a block diagram of a typical T/R.

As shown in FIG. 3, the transmitter/receiver includes eight functional units; a CPU 25 which in a preferred embodiment of the invention comprises a microprocessor such as the INTEL 8085A with associated RAM and ROM. In communication with the CPU 25 through its input/output ports is a receiver 30, an (optional) approach detector 29, a positive pulse generator 27, a negative pulse generator 28, a vital driver 26, output relays and their drivers 32 and, if the T/R is located at an intermediate insulated joint and thus has an associated T/R, the CPU 25 also directly talks to the CPU in the associated T/R. The actual connections between the T/R and the track are made via a track suppression unit 31 which is used for purposes of filtering, etc. Finally, through joint operation of the CPU 25 and the vital driver 26, output relays 32 are selected and energized, if appropriate. These output relays typically are used to control local signal lights associated with the T/R based on information received via the track current. Although enabling inputs to the output relays 32 and the pulse generators 27 and 28 are provided directly by the CPU 25, an additional check signal is required to operate either the pulse generators 27, 28 or those of the output relays which are considered vital.

The check signal is derived from the vital driver 26. Actually the vital driver 26 consists of a pair of tuned vital drivers, examples of which are given in Sibley U.S. Pat. Nos. 3,995,173 and 4,090,173, both assigned to the assignee of this application. The input signals to these two tuned vital drivers are provided by the CPU 25 and shown in FIG. 3 as transmit VD and receiver VD. For normal operation of the CPU 25, corresponding appropriate outputs are produced. In the absence of these checking signals from the vital driver 26, neither the pulse generators 27, 28 nor the vital output relays can be operated.

As will be described, the apparatus shown in block diagram form in FIG. 3 is capable of operating as a head end T/R (driver or follower) or an intermediate T/R, by personalizing several inputs.

A head end (driver) T/R performs the function of periodically transmitting a selected (by another personalizing input) pulse group. In order to control the reverse running signals at the location, it is also capable of receiving coded information via the track rails to control those reverse running signals. The operation of a head end (follower) is similar except that it has a different transmitter rate (typically slower than that of the driver) so that when the controlled territory is entirely unoccupied, the head end (follower) always receives a code group before its own timer function times out and therefore operates in an entirely dependent manner. In the event of occupancy of one of the track sections in the controlled territory, however, the head end (follower) fails to receive a code group and therefore initiates independent coding at the slightly slower rate. The head end (follower) can then be recaptured by the head end (driver) when the controlled territory is cleared so that the head end (follower) resumes its dependent operation.

The operation at an intermediate is different only in that due to its personalizing inputs, it only independently codes under very limited conditions. Normally, the intermediate will be receiving code from the head end (driver or follower) which is decoded and passed on to the associated intermediate. The associated intermediate, in addition to transmitting on this information also receives code groups initiated at the other head end, and this information is passed on to the first mentioned intermediate where it is used to maintain the continuity of information flow. In the event that a T/R intermediate senses an approaching vehicle (via its approach detector, if available) it may enable a stick function. In the absence of an enabled stick function at one T/R the associated T/R is allowed to enable its stick function. With the stick function enabled the T/R can code independently for so long as the stick function is enabled. To maintain safety, a stick function can be enabled only at one of a pair of intermediate T/R's. In a like manner, before a vehicle has passed an intermediate T/R, inverse coding may be allowed (again by another personalizing input).

In order to maintain the appropriate functions, any CPU 25, in addition to receiving the personalization inputs (determining whether it is a head or intermediate, and if a head whether it is a driver or follower) also senses train presence via signals from the receiver, and in a manner to be explained controls that receiver so that it operates properly, receives approach information via the approach detector (if installed) outputs enabling signals to the pulse generators 27, 28 in the appropriate sequence to place a code group on the track rails, and so long as its self-checks do not reveal any faults, provides the appropriate signals to the vital driver 26 to enable the pulse generators and output relays.

Figure 4A:
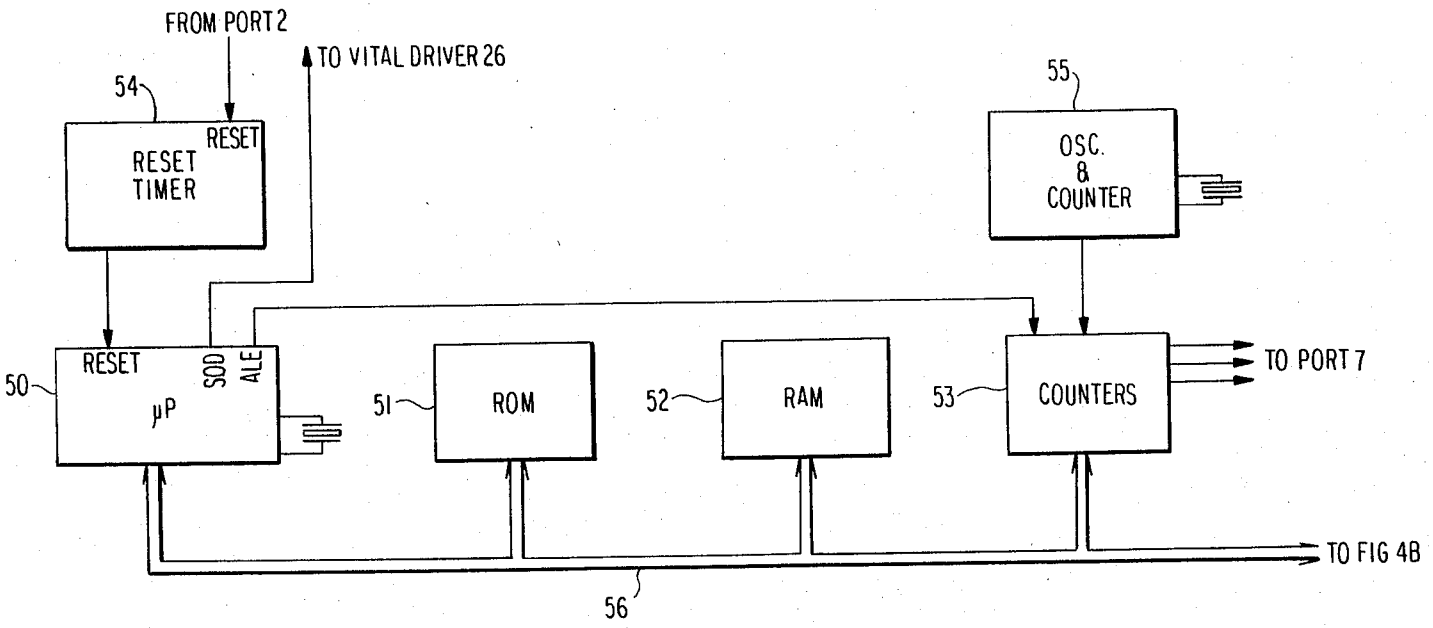
FIGS. 4A to 4C are schematics of CPU 25 of FIG. 3 when placed adjacent each other in alphabetic order.
Figure 4B:
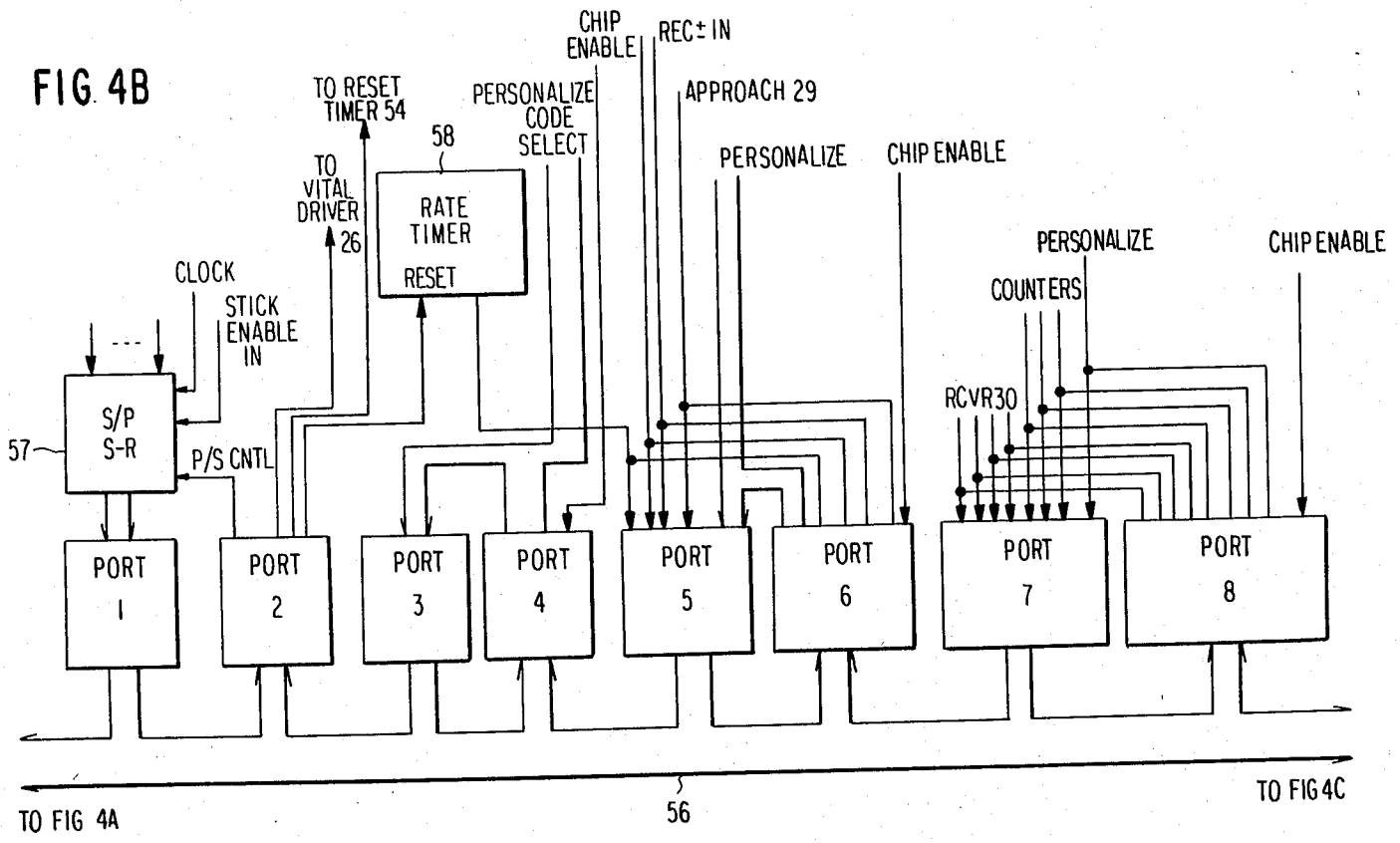
Figure 4C:
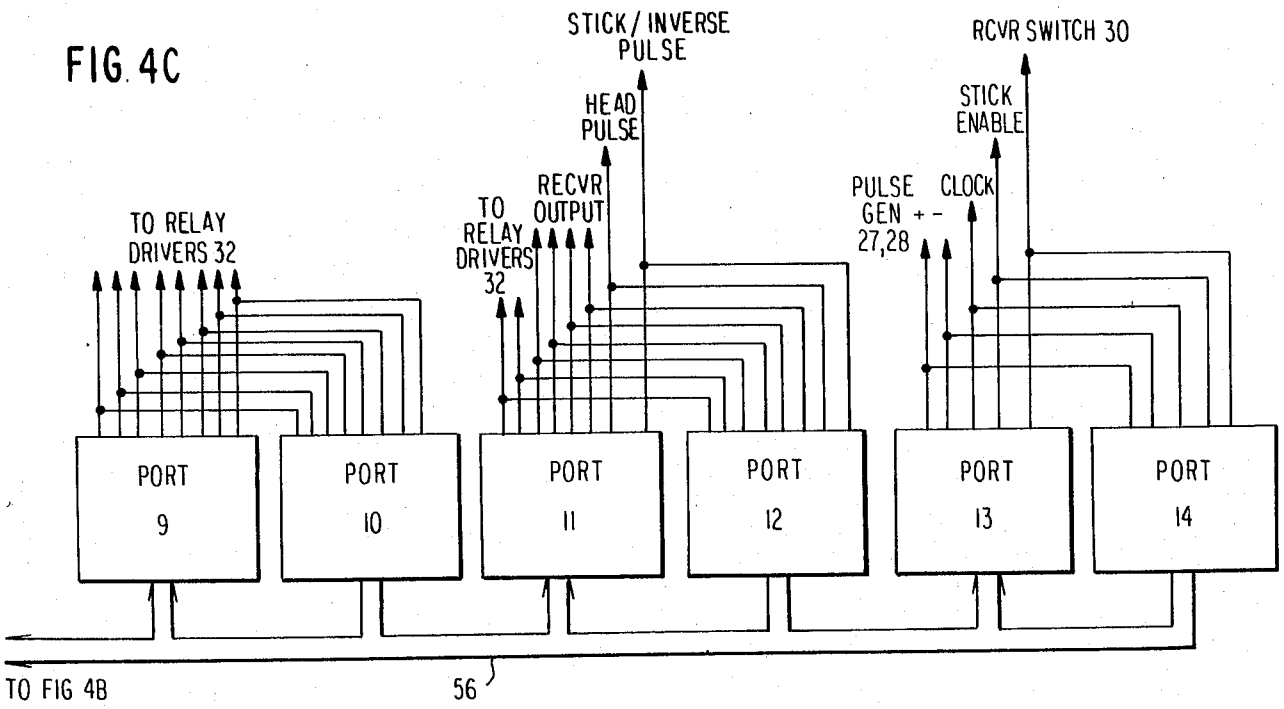

FIGS. 4A–4C, when associated end to end as indicated in the diagrams provide a schematic of the processor 25. As shown, a data/address bus 56 couples a number of functional units including a microprocessor chip 50, ROM 51, RAM 52, a trio of counters 53, and I/0 ports 1–14. Those skilled in the art will understand that illustration of single ROM 51 and RAM 52 is only for convenience. Communication between a microprocessor 25 at a double intermediate with an associated microprocessor 25 is carried out in serial fashion with a parallel input as a check. A stick enable from port 13 is the serial output and a fixed multi-bit sequence provides the parallel input. At the other microprocessor both the serial and parallel inputs are coupled to a shift register 57 which can operate in either serial or parallel fashion under control of a parallel/serial (P/S) control signal from port 2. The data received in the shift register 57 is input through port 1. The CPU 25 provides two different forms of outputs; a first set of outputs is used to drive the relay drivers 32, this is derived from port 9, and a second set of outputs drives the transmit generator from port 13. The result of the processor's self-checking operation is a pair of VD signals output to the vital driver 26 via the microprocessor chip 50 and port 2.

Before describing the software and the operation, reference is made to FIGS. 5A, 5B and 6–8 to illustrate in detail the associated apparatus shown in block diagram form in FIG. 3.

Figure 5A:
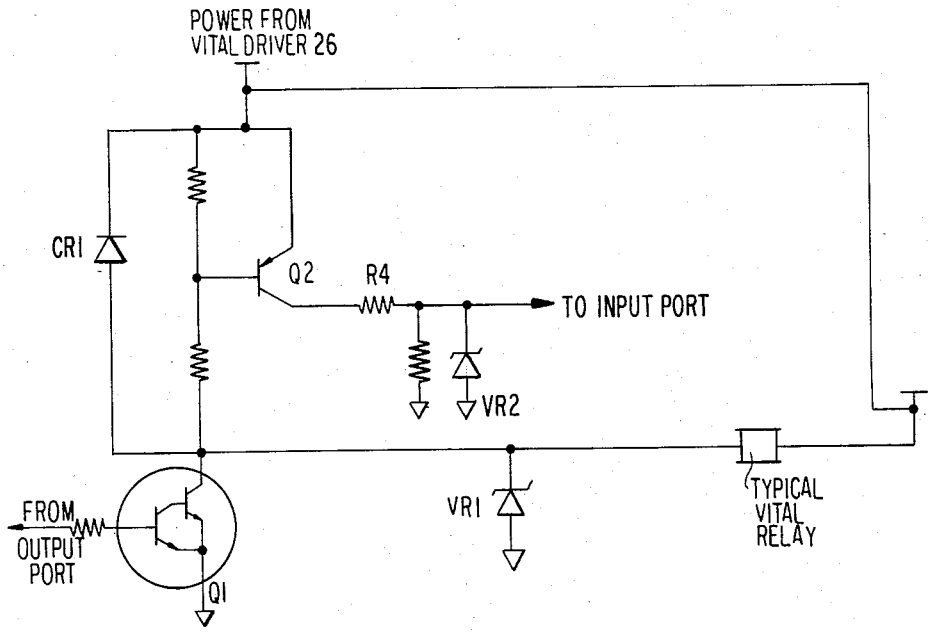
FIGS. 5A and 5B illustrate respectively a relay driver and bipolar signal driver which is driven by the outputs of CPU 25 and vital driver 26 of FIG. 3.
Figure 5B:
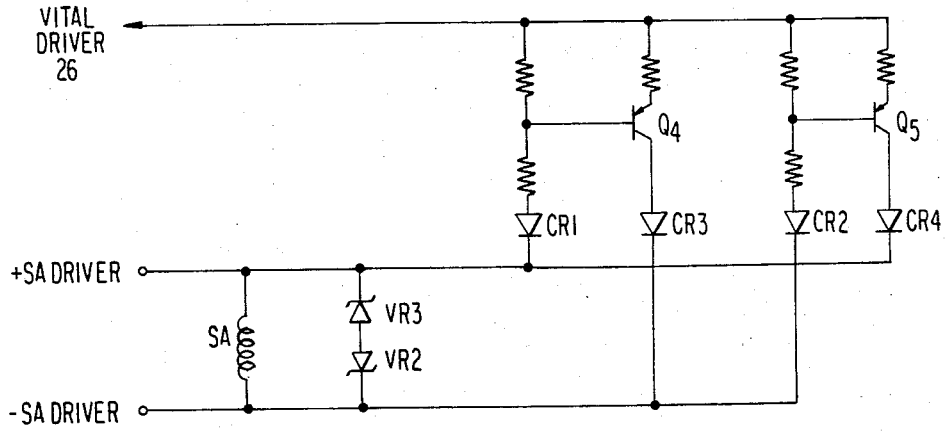

Reference to FIGS. 5A and 5B discloses two types of relay drivers contained in the output drivers and relay block 32. FIG. 5A illustrates a relay driver for a unipolar vital relay or an optional local stick relay. When the associated output port (coupled to the base resistor of Q1) is set high, Q1 is turned on sinking current from the vital driver supply through the relay coil of the "typical vital relay" shown in FIG. 5A. A zener diode CR1 reduces transients caused by interrupting the relay current during a check cycle (to be explained) and protects the internal electronics from induced transients on the relay wiring. When Q1 is turned on, as described above, current also flows through the collector resistors to turn on transistor Q2. Turning on Q2 supplies an input voltage to the port check, limited by R4, R5 and VR2. This can be used to verify that the transistor Q1 is on and thus the relay is picked. When Q1 is turned off, Q2 is turned off and the output voltage to the input port is removed, which can be used to verify that the relay is not picked. Leakage across the collector emitter terminals of Q1 may result in Q2 remaining on which could lead to a false indication at the input port; this is however a detectable failure. Proper selection of the collector resistors of Q1 places the leakage detection threshold high enough so that a failure will be detected before enough leakage is present to falsely hold the relay energized.

The T/R can also be used to drive a bipolar signal mechanism or SA, also in a vital fashion. This driver circuit is shown in FIG. 5B. The output terminals +SA driver and −SA driver are connected to output drivers such as that shown in FIG. 5A, and which one of the drivers is on determines the direction of current flow through the coil SA. For example, if the −SA driver is on (that is tied to ground through the associated transistor Q1) then Q5 is turned on by reason of the voltage drop across the resistor connected between its base and CR2. Q5 thus supplies current from the vital driver supply through the SA coil to the −SA driver terminal (which is the only terminal coupled to ground). On the other hand, if the +SA driver terminal is turned on (tied to ground) then transistor Q4 is turned on via the voltage drop across the resistor between its base and CR1. This supplies current to the other SA coil terminal which then flows through the coil to the +SA driver terminal. In either event, current is supplied by the vital driver 26 and thus only available if the appropriate check output is provided by CPU 25. As will be explained, the condition of the drivers associated with the +SA and −SA terminals are checked under program control. VR2 and VR3 are used to reduce voltage created from energy stored in the inductor when the states rapidly change during a check cycle. Accordingly, appropriate output selection results in vitally driving the bipolar signal mechanism SA.

Figure 6:
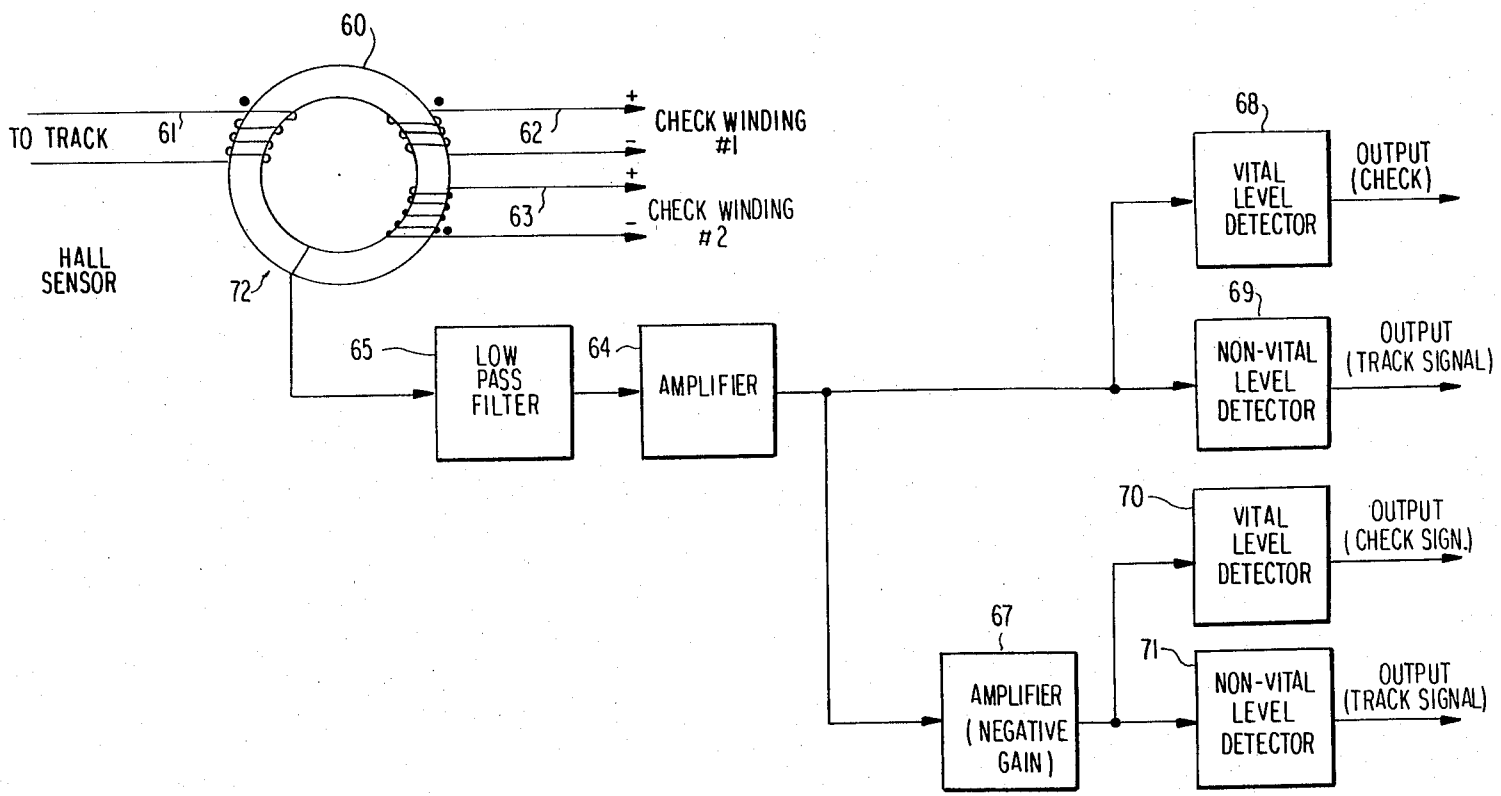
FIG. 6 is a block diagram of receiver 30 of FIG. 3.
Figure 7:
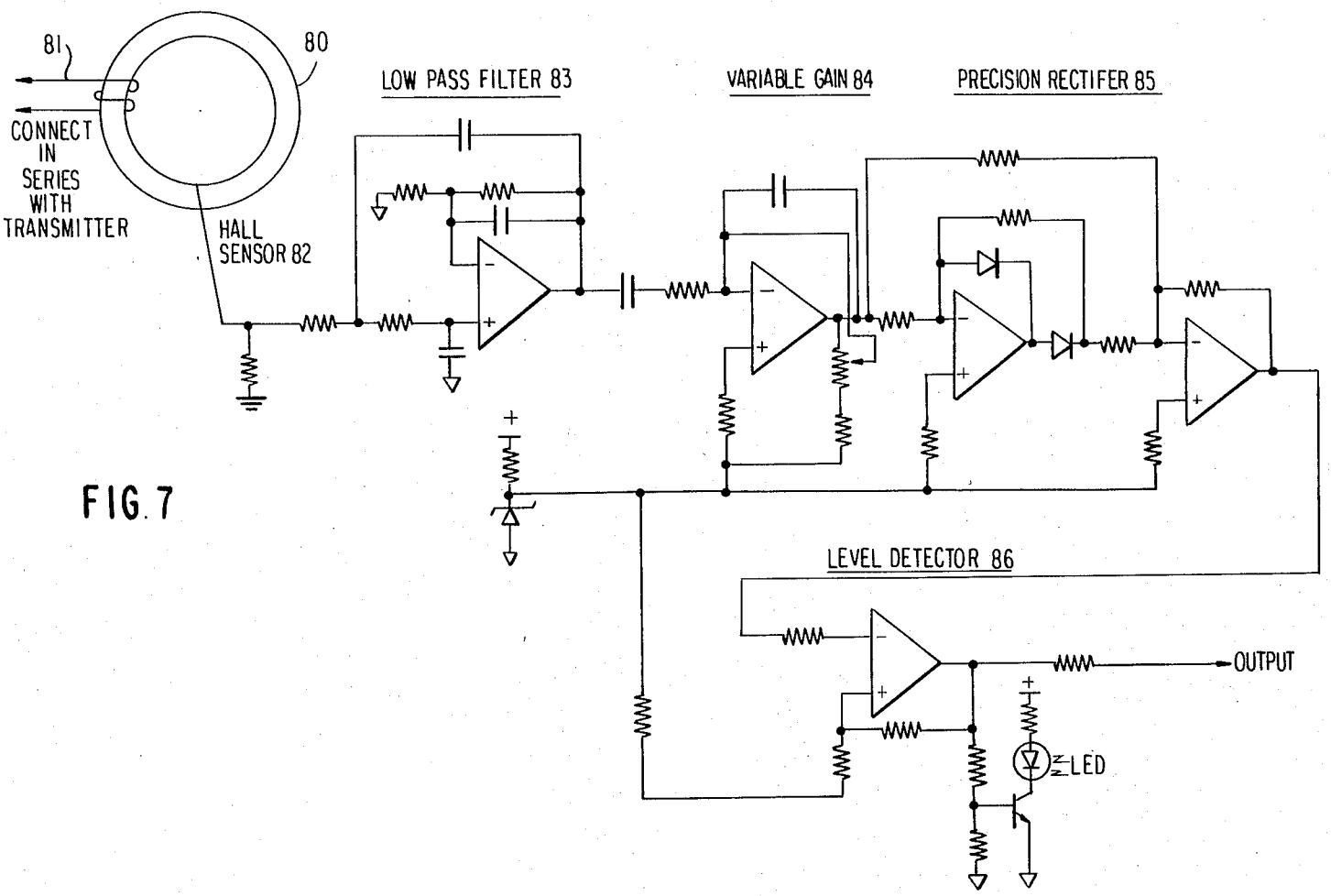
FIG. 7 is a schematic of approach detector 29 of FIG. 3.

FIGS. 6 and 7 show, respectively, block diagrams of the receiver 30 and approach detector 29. Both the receiver and the approach detector operate by detecting changes in current level in the track; the receiver operates by detecting changing current levels in the track produced as a result of pulse generation by a T/R located at a different end of a track section than is the receiver. On the other hand, the approach detector operates by detecting changes in current level in the track produced as a result of the pulse generator included in the T/R pulse generator. The effort to eliminate current sensing relays results in the loss of a very effective current detector. While transformer based current detectors operate quite well at higher frequency track currents, with the pulse rates typically employed in this application (typically less than 10 pulses per second, and most typically less than 5) such transformers would be prohibitively large. Accordingly, the receiver and approach detector are based on the use of a Hall sensor located in an air gap in a toroid which is magnetically coupled to the track rails. In one embodiment the toroid was made of Silectron. Inasmuch as the approach detector is not a vital function, it is the simpler of the two. Referring then to FIG. 7, a toroid 80 has a Hall sensor 82 located therein and is coupled via one or more turns of a conductor 81 which is connected in series with the output of the pulse generators 27 and 28. As a result, when either of these pulse generators are enabled, current flows in the conductor 81 and a magnetic field is coupled to the Hall sensor 82 which produces a corresponding voltage. The output of the Hall sensor is first low pass filtered via the low pass filter 83 and then AC coupled to a variable gain amplifier 84, a rectifier 85 and a level detector 86. The AC coupling eliminates response to continuous signals. The low pass filter 83 removes objectionable 60 hertz components or the like. An adjustable gain of variable gain amplifier 84 allows a common unit to be applicable to track circuits of varied parameters. The amplified signal is rectified in the two stage precision rectifier 85. The output of the precision rectifier 85 is a pulsed DC level proportional to either positive or negative current pulses on the rail. The rectified signal is then compared, in a level detector 86 with a fixed threshold. The output of the level detector 86 is a digital signal which achieves one of two levels depending on the comparison between the output of the precision rectifier 85 and the preset threshold. Thus, for example if the current levels in the rails exceeds the threshold, an approach indication is provided, and vice versa. An LED is provided as a visual indicator of approach detection, which is useful for maintenance purposes.

FIG. 6 illustrates a block diagram of the receiver, which is more complicated in that it performs a vital function of detecting occupancy. As shown in FIG. 6, the now familiar toroid 60 is coupled via a conductor 61 to the track rails themselves. The toroid 60 includes the Hall sensor 72, but also includes one or more windings of conductors 62 and conductor 63. The conductors 62 and 63 form a pair of check windings which are operated in a manner to be explained to verify the proper operation of the receiver. The output voltage of the Hall sensor 72 is coupled via a low pass filter 65 and amplifier 64 to an amplifier 67. The output of amplifier 64 is connected to a pair of level detectors 68, 69 and the output of amplifier 67 is connected to the input of level detectors 70 and 71. Since the amplifier 67 is arranged with negative gain, positive and negative pulses at the input to the filter 65 produce positive pulses at the level detectors. The output of amplifier 64 is coupled to a vital level detector 68 and a non-vital level detector 69 whereas the output of amplifier 67 is coupled to a similar vital level detector 70 and a non-vital level detector 71. The basic operation of the receiver is similar to the approach detector wherein the output of the amplifier 64 or 67 is proportional to current level on the rails (in this case low current level may indicate occupancy). The current level representative output voltage may then be compared in the level detector against a threshold and a digital output is provided to indicate occupancy or non-occupancy.

Since unsafe failures are those which produce a false lack of occupancy indication, the failure to be guarded against is a drop in the threshold of the level detector, for it is only a failure in this direction which can produce a false non-occupancy indication. To guard against this, a checking operation is provided, carried out jointly by the receiver and the processor 25. To effect this, the vital level detectors 68 and 70 have their thresholds set below that of the other level detectors (in a preferred embodiment for example 50% below). During normal operation, when sufficient track current is available, both vital level detectors will see an input above their respective thresholds and their outputs will indicate non-occupancy. However, for a portion of the time the receiver is operative, the conductor 61 is opened and one or the other of the check windings is energized with a current level which is sufficient to exceed the threshold in the vital level detectors 68 or 70 but inadequate to exceed the threshold in the other level detectors 69 or 71, respectively. The two check windings are used (wound in opposite senses) so that each exercises one of the two channels in the receiver. The receiver can be channelized to a positive channel (terminating in level detectors 68, 69) and a negative channel (terminating in level detectors 70, 71). During a check cycle, verifying that only the vital level detector is tripped (and not the other) ensures that the system gain has not been excessively increased or the threshold of the non-vital level detector has not been sufficiently decreased as to pose a safety hazzard. An opposite failure, i.e. a decrease in system gain or an increase in the non-vital level detector threshold is safe since neither can mask an occupancy condition. Unsafe increases in the check current (which could offset or mask an unsafe decrease in threshold) is guarded against since that failure will trip both the level detectors. On the other hand, a decrease in the check current is detectable since it will not trip either level detector. In a preferred embodiment of the invention, the current level in the check conductors 62 and 63 is significantly less than typical track current in conductor 61. This is offset by the greater number of turns linking conductors 62 and 63 with the toroid as compared with conductor 61.

Accordingly, to operate the receiver in a vital fashion a receiver check time is provided in which firstly the conductor 61 is opened and then one or the other of the conductors 62 or 63 is energized with an appropriate current level and the output of the four level detectors is analyzed. By providing two such check periods (one for each channel in the receiver) in any cycle, safe operation of the receiver can be verified. Referring briefly to FIG. 4B, port 7 receives four outputs from the receiver 30 corresponding to all four of the level detector outputs and port 13 provides a control for the switch in the conductor 61 for disconnecting conductor 61 from the track rails during the check times.

A more complete description of the receiver and approach detector is provided in the copending application of Petit and Smith entitled "Non-Contact Isolated Current Detector", filed simultaneously herewith (Ser. No. 356,080). The disclosure of that application is incorporated herein by reference.

Figure 8:
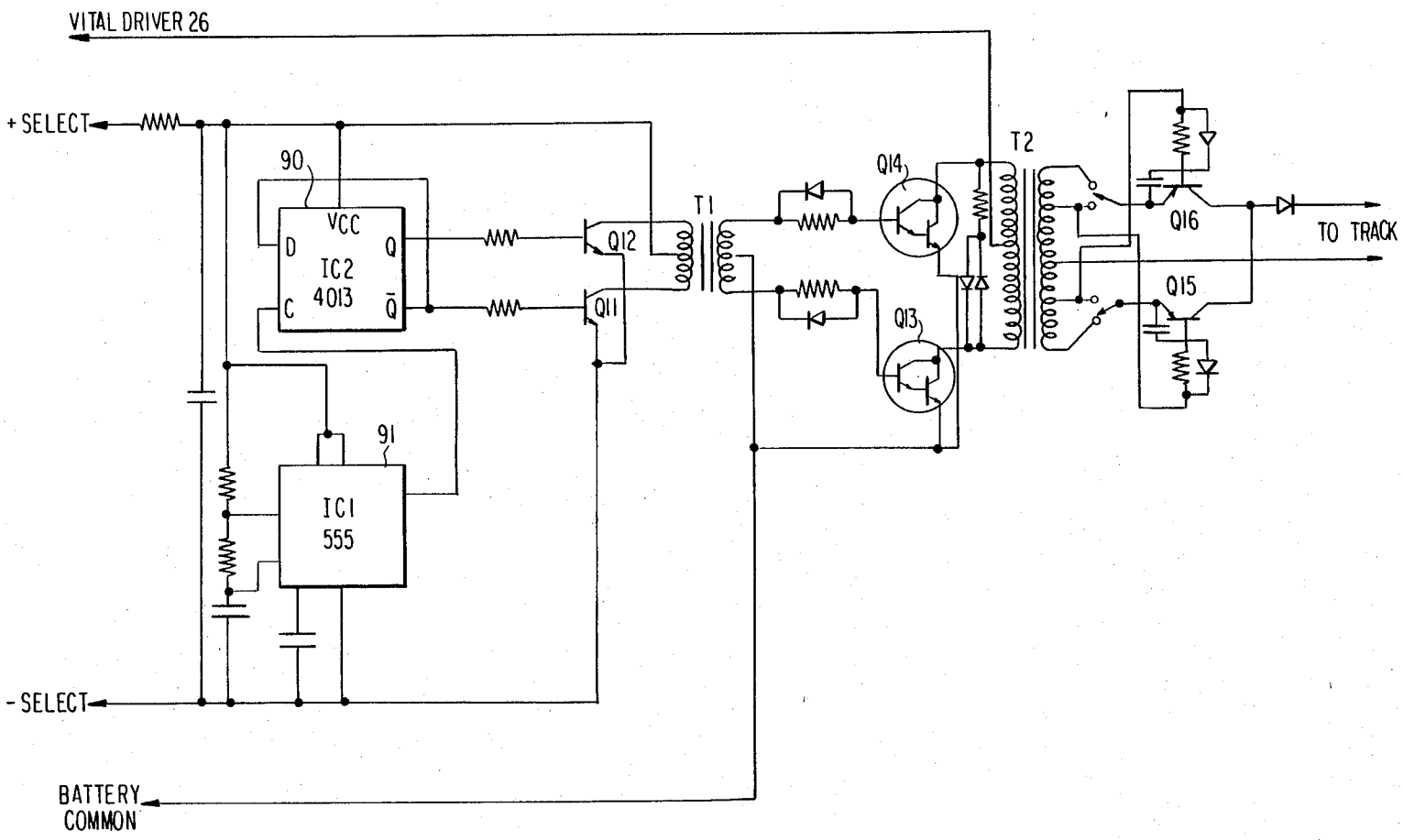
FIG. 8 is a schematic of one pulse generator such as 27 or 28 of FIG. 3.

A typical pulse generator such as that found in the generators 27 or 28 is shown in FIG. 8. The pulse generator is a solid state code pulse converter. It produces DC pulses to be applied to the rails using a 12 volt signal battery (and eliminates the previously required two volt track battery and associated relay). The pulse generator is vital in that no current will be applied to the rails unless an output is provided from the CPU 25 (which serves to select the pulse generator 27 or 28) along with an appropriate output of the vital driver 26 which serves to power both the pulse generators. As shown in FIG. 8, an astable multi-vibrator 91, a D type flip-flop 90, connected as a divide by two circuit, and transistors Q11 and Q12 connected as a push-pull amplifier, are employed. When a one or the other of the pulse generators 27 or 28 is selected by the output of the CPU 25 (particulary from port 13—see FIG. 4C) the astable multi-vibrator 91 oscillates (in an embodiment of the circuit which has been constructed, at 16 kilohertz). The divide by two flip-flop produces an approximately 8 kilohertz output at a 50% duty cycle. The output and its inverse are supplied to the transistors Q11 and Q12 which amplify the signal and couple it to the next stage via transformer T1. The transformer T1 serves to isolate the selection and input stages from the power supply. The 8 kilohertz signal on the secondary of T1 drives transistors Q13 and Q14. This is a power amplifier stage and used to chop the nominal 12 volt supplied by the vital driver 26 (when enabled) at the 8 kilohertz rate. The LED coupled between transistors Q13 and Q14 provides an indication. The output of this stage is provided to the primary of transformer T2. Transformer T2 is a step down transformer and depending on the tap settings on its secondary can provide 1.2 or 2.4 volts DC. Transistors Q15 and Q16 are used as controlled rectifiers to rectify the output. The transistors are used rather than rectifiers so that the outputs of the two pulse generators 27 and 28 (nominally opposite in polarity) can be coupled together in parallel across the track without the off pulse generator shorting out the output of the on pulse generator. The diode coupling the collectors of Q15 and Q16 to the track rails is used to prevent AC signals on the rails from causing reverse conduction in the output transistors.

In view of the foregoing description of the pulse generators, the receiver, approach detector, output relays and drivers it should be apparent that each transmitter/receiver is capable of selectively placing a pulse or a sequence of pulses of either polarity onto the track rails, detecting changes in the current level indicative of an approaching vehicle, detecting a pulse or a sequence of pulses of either polarity placed on the rails by another transmitter/receiver, all under control of the CPU 25. The CPU 25 in turn operates under the control of software (or firmware), the flow charts for which are shown in FIGS. 9A–15, inclusive.

At the outset it should be noted that all of the software shown in FIGS. 9A–15 is not initially resident in the CPU 25. Rather, using techniques disclosed in Sibley patent application Ser. No. 273,299 filed June 15, 1981 for a "Vital Communication System" and assigned to the assignee of this application, which is incorporated herein by reference, some of the software shown in FIGS. 9A–15 is actually created during the running of the remaining software, as will be explained hereinafter.

Figure 9A:
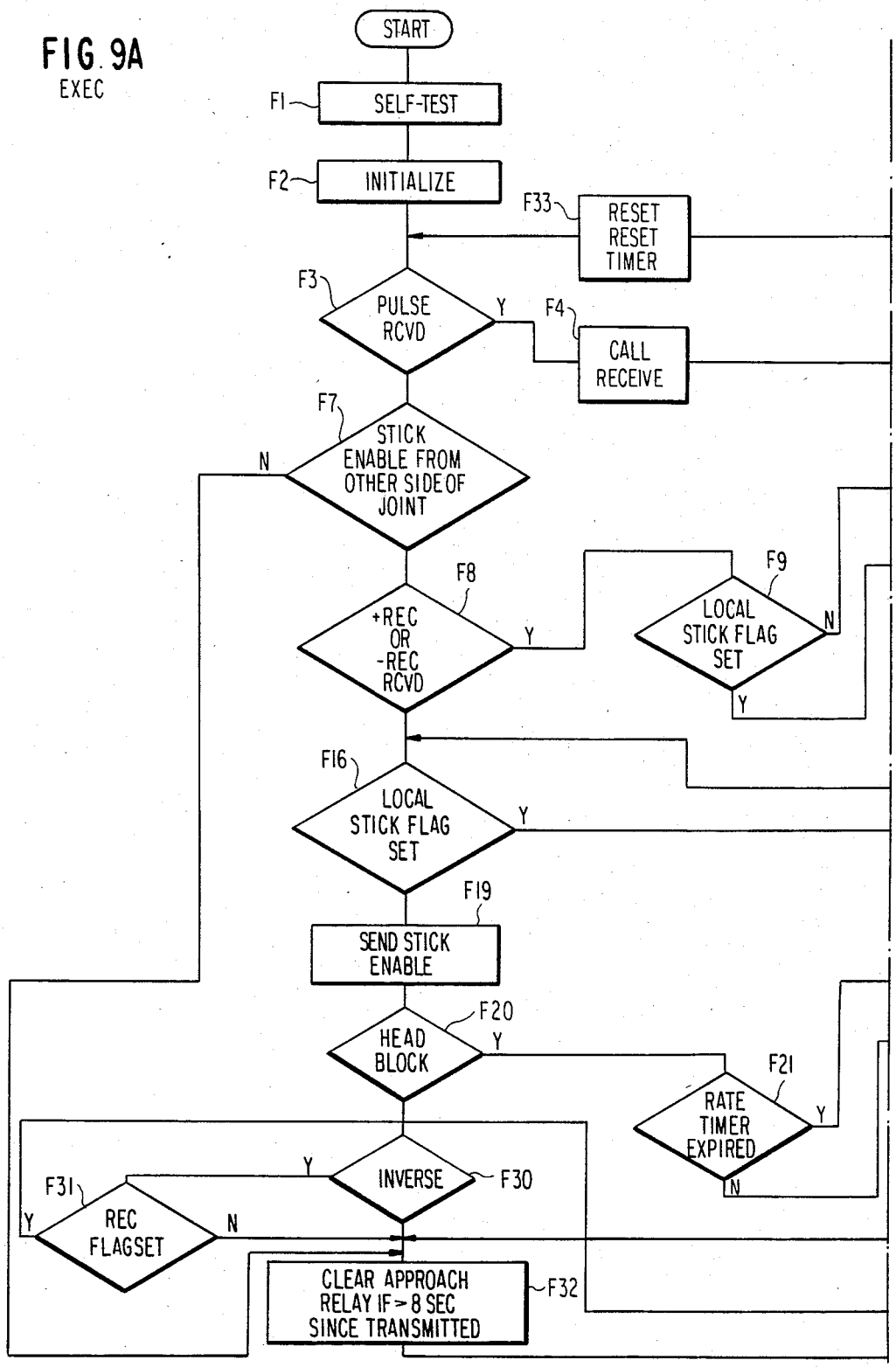

The software shown in FIGS. 9A–15 comprises an executive routine and a plurality of sub-routines called by the executive. The executive routine is shown in FIGS. 9A and 9B. As shown in FIG. 4A microprocessor 50 is capable of being reset via a reset timer 54, which itself can be reset via the CPU. During normal operation the reset timer 54 is reset by the CPU at such a rate that the timer 54 never expires. However, if in the course of running the CPU goes into a halt state for any reason, the reset timer 54 will expire, resetting the microprocessor to reinitiate running of the executive. This technique is advantageous in that, under certain circumstances the CPU will intentionally go into a halt state (for example if an error is detected). In the halt state all of its outputs are dropped. This has the effect of removing any code from the track rails and accordingly no signals will be cleared. This is considered a fail-safe mode since under these circumstances no vehicles are allowed to move. The system becomes reinitiated when the halted CPU in the controlled territory is reset by expiration of reset timer 54.

As alluded to earlier, the vital drivers 26 require a pair of inputs of a specific frequency. One of these inputs is developed by the microprocessor chip 50 and output directly by the chip itself, another input is output via a terminal in port 2 (see FIG. 4B). The vital driver sub-routine which directly generates these outputs is an improvement of techniques described in Auer et al U.S. Pat. No. 4,168,526 (assigned to the assignee of this application) and U.S. Pat. No. 4,181,849 also assigned to the assignee of this application. The vital tuned driver 26 is arranged so that, in the event the vital driver output is not of the appropriate frequency and essentially continuously present, the output of vital tuned driver 26 decays to zero. In the absence of the output of vital tuned driver 26 the associated equipment (either the pulse generators 26, 27 or the vital relays 32) are either inhibited from operating or caused to open. In an embodiment of the invention which has been constructed, the vital driver sub-routine must be run at least once every 50 milliseconds to prevent the decay in the output of the tuned vital driver 26.

In the course of running the executive, and more particularly the transmit and receive subroutines called thereby, various check words are stored; which words are stored is determined by the logic path taken through the subroutine. Accordingly, the check words provide a road map of the processing logic that has been followed. Since there are several appropriate logic paths there is more than one set of check words which indicates appropriate operation. Nevertheless these sets of check words can be tested to determine whether the operation is proceeding as desired. For example, as disclosed in the Sibley application Ser. No. 273,299, the check words can be used as the instructions in a subroutine, or a portion of the instructions in the subroutine to produce an appropriate output only if one of the appropriate check word sets are present. Since the instructions which are represented by the check words are neither initially present nor static (since once used they are deleted) an appropriate continuous or substantially continuous output requires continued production of appropriate check words. In an embodiment of the invention which has been constructed, the number of check words produced by operation of the transmit and receive subroutines exceeds the quantity which can be directly used in the manner described in this referenced Sibley application. Accordingly, as each group or subgroup of check words is produced, a signature analysis is performed (for example a cyclic redundancy check) and the results of the signature analysis (for example the residue in the CRC operation) is used as one or a sequence of instructions, and only when all check words have been analyzed is an appropriate sequence of instructions produced which comprises the vital driver sub-routine or a portion thereof. The executive then can call the vital driver sub-routine which, having been created, enables the appropriate vital driver output to be produced, and then as part of its running destroys itself so that it must again be created before it can be again run. In this fashion, in connection with the transmit function, the transmit subroutine must be run correctly in order to produce the appropriate check words to create the transmit vital driver subroutine so that the transmit vital driver output will be essentially continuously present to enable the transmit tuned vital driver 26 to produce the enabling output signal to enable the pulse generators for the transmit function itself.

The receiver function operates in a similar fashion.

Turning now to FIGS. 9A and 9B, a flow diagram for the executive is illustrated.

The first function, F1 is a self-test including tests of all the I/O ports and a test of the receiver. In addition, all the flags are set in an appropriate condition and the ports are initialized. Function F2 initializes an address register pair for storing check words. Function F3 is the first substantitive decision point in the program and it determines if a pulse is being received by the receiver (the manner in which this is determined will become clear in a following discussion of FIGS. 4A–4C). Assuming that a valid pulse is being received, function F4 calls the receive subroutine (which will be discussed in connection with the flow chart therof), at this point it is sufficient to note that the subroutine determines if a valid pulse is being received, decodes the received signal and provides an output to the appropriate relay. It also restarts a counter which will have the effect of dropping the appropriate relay output if further signals are not received in a predetermined period of time (in one embodiment about 5 to 12.5 seconds).

Assuming that no received signal is present, function F7 reads the stick enable port. At the stick enable port an 8 bit word may be available from a CPU 25 of an associated T/R (for example at a double intermediate). Absence of the stick enable indicates that the associated T/R has its stick enabled. Simple analysis indicates that if one T/R of a pair has a stick enabled then the T/R should not transmit. If an appropriate signal is not present then all functions which allow transmission are skipped.

If a signal is available at the stick enable port, it is read in serially. A fixed input is subsequently read in in parallel at the same port as a test of the proper functioning of the port. The stick enable signal, if present, indicates that the associated T/R does not have an active stick function and therefore the T/R receiving the stick enable is allowed to have an active stick function. Assuming the port test associated with receipt of the stick enable is passed, function F8 is performed to determine whether or not +REC or −REC is being received. If either is being received it indicates that the T/R on the other side of the joint is receiving a pulse, and therefore the T/R under discussion may want to transmit corresponding information to maintain continuity of information flow across the insulated joint. Accordingly, if either specified signal is being received, then function F9 first determines if the local stick flag is set (the local stick flag corresponds to the presence of an active stick function at the T/R unit under discussion). Assuming the local stick flag is not set then the processing skips directly to the transmitter routine via the call of function F14.

On the other hand, if the local stick flag had been set then several checks are made at F10 and F11 to determine if the first trigger pulse flag is set (the signals +REC or −REC are referred to as trigger pulses) and if the first trigger pulse flag is not set then function F12 sets it. If, however, this is a pulse subsequent to the first then the first trigger pulse flag will have been set on a previous pass and function F11 determines if 5 seconds have passed since the flag was set. If that is the case then function F13 is performed to clear the local stick flag and then the transmit function is performed via the call at function F14. In other words, if two trigger pulses are received (corresponding to the receipt of two pulses by the T/R on the other side of the joint) within 5 seconds, but more than 1 second apart, this indicates that the adjoining track circuit has seen two successive valid pulses indicating that the adjacent circuit is not occupied and therefore the local stick flag can be cleared. If these conditions are not met then function F16 is performed to check the local stick flag. If the flag is set then the stick function is called at F17. Assuming it is not set then function F19 sends a stick enable to the T/R on the other side of the joint. Function F20 then checks to see if this unit is defined as a head (a personalizing input). If this is a head then function F21 is performed to check the rate timer; this is a hardware timer which sets the rate at which transmissions are effected. If the rate timer has expired, functions F26 through F29 are performed to first reset the rate timer (to time a next period), clear the receive flag and call the head subroutine. On the other hand, if the rate timer had not expired then function F20 determines if this is a follower. The rate timers in driver and follower are set differently so that normally the rate timer in a follower will not expire (i.e. the rate timer in a follower is set longer than the rate timer in a driver). Accordingly, if this unit under discussion is a follower and if the receive flag is set (checked at function F25) then the same functions F26 through F29 are performed as if the rate timer had expired. The receive flag is set, by the receive routine as will be explained, on detection of a valid code group.

However, after performing function F22, function F23 is performed to check if an inverse function had been selected (another personalizing input).

To explain the inverse function we refer briefly to FIG. 1 and assume that a vehicle is in section B. Signal transmission through the rails from 10-HD to 10I-1 is continued via 10I-2, however the presence of the vehicle in section B means that 10I-3 will not receive those signals. This causes a track occupancy detection, and also means that the follower 10-HF will not be receiving signals. As a result, the follower codes independently and transmits to 10I-6 which causes 10I-5 to transmit to 10I-4. These transmissions enable the signals in front of the vehicle in section B to be cleared. It may be desirable, however, for the transmission from 10I-4 to be made to 10I-5 and through 10I-6 to 10-HF, for passing information in that direction. This is effected, for example at 10I-4 by selecting an inverse function; in effect it enables the intermediate to act, temporarily as a head. If an inverse had been selected accordingly, function F24 checks to see if a plus code is received. Receipt of the plus code indicates that an intermediate is acting as an inverse block and thus its signals should not be mistaken for that of a head driver (the follower should transmit on expiration of its rate timer since the inverse block always assumes the function of the follower). On the other hand, if the plus code has not been received then function F25 checks to see if the receive flag is set. The inverse input is continuously selected at a head block if inverse code is ever expected. F25 allows for normal follower operation if some code group other than plus is received. Of course, codes other than + could be used for the same purpose. The use of + is only an example.

If, on the other hand, at function F20 it was determined that this is not a head then function F30 checks to see if an inverse has been selected. If it is, function F31 checks the receive flag, since an inverse function at an intermediate always operates as a follower; it only transmits when the receive flag is set. If not set, then no transmission will be effected. On the other hand, if it is set, then processing skips to function F27 to perform functions F27–F29.

At this point, the substantitive processing has been concluded, function F32 checks to see if no transmission has been effected for 8 seconds or more. If that is the case, then the approach relay is cleared. After function F32 the vital driver routine F6 is run for a fixed period or until a signal is received or a trigger pulse seen. In either event (expiration of the predetermined period or receipt of one of the signals being looked for) function F33 is performed to reset the reset timer and then the processing loops back to function F3. Function F6 is implemented by running the vital driver for a fixed period (substantially less than 35 milliseconds, 11 milliseconds in one embodiment of the invention) after which flags are checked to see if either of the signals being looked for has been received. If any flag is set, then function F6 is terminated, if the flag is not set the vital driver is again run for another short period and the preceding functions are repeated.

An overview of the executive then indicates that it monitors several signals and in a substantitive sense calls receive, transmit, stick or head, the first subroutine validates received signals and determines what code has been received, transmit, stick and head may themselves result in code transmission depending on a variety of circumstances. Concluding each of these subroutines is a function to run the vital driver subroutine (F5, F15, F18 and F29).

Figure 10A:
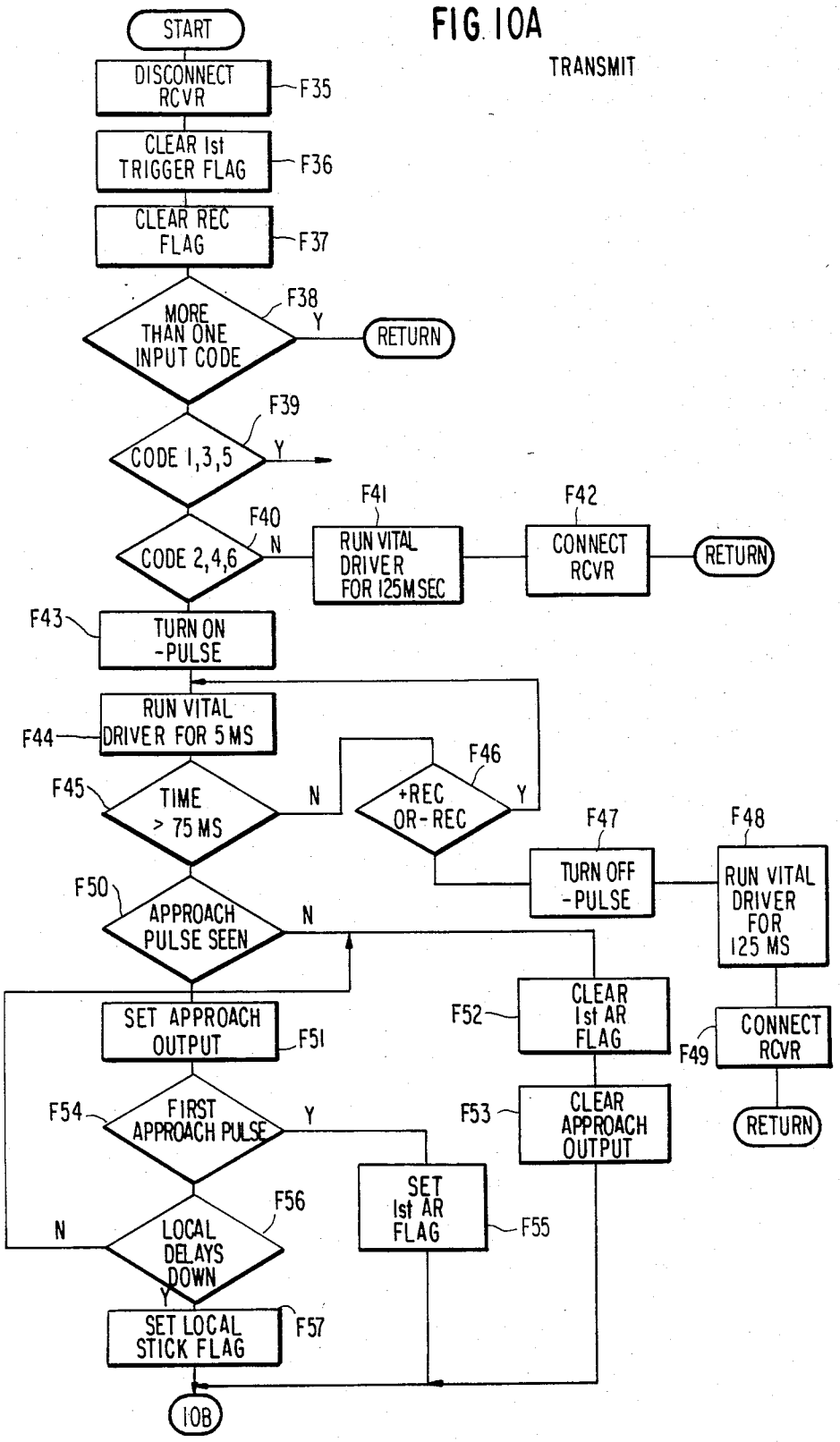
Figure 10B:
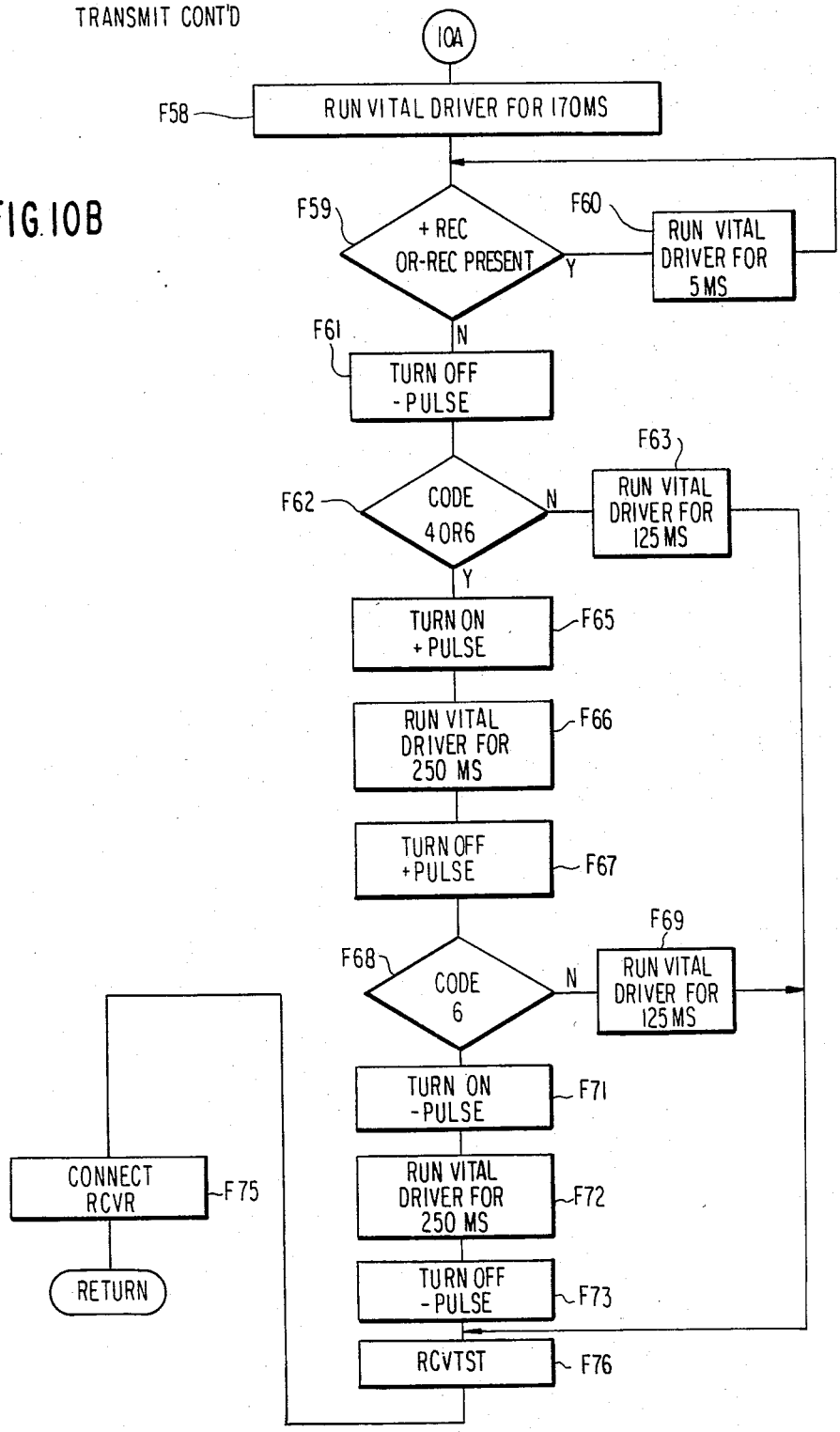

In order to see the functions performed in the transmit subroutine reference is made to FIGS. 10A and 10B illustrating the transmit subroutine. The first function, F35 disconnects the receiver; since the receiver is connected across the track rails at the same point as the pulse generators, and the receiver impedance is substantially zero (i.e. about 0.5 ohms), disconnecting the receiver ensures that the transmitter is not transmitting into a short circuit. Functions F36 and F37 clear flags representing the first trigger pulse and the receive flag. The first trigger flag is set in the executive routine, the receive flag is set in the receive subroutine. After clearing these flags function F38 checks to see if more than one code is selected to be transmitted. If more than one code is selected, a return is made to the Executive, no transmission is effected. The manner in which a code is selected is determined in part by personalizing inputs and in part by a received code unless the T/R is a head (driver). Assuming that more than one code is not seen, then functions F39 and F40 determine which type of code is to be transmitted. Codes are arranged in two groups depending on the polarity of the first pulse, using arbitrary nomenclature one group has codes 1, 3 and 5 and the other has codes 2, 4 and 6. Those skilled in the art will, after reviewing this description, be able to use more, less or different codes. The processing for codes 1, 3 and 5 is not explicitly shown although after a review of the functions shown in FIGS. 10A and 10B those skilled in the art will readily understand how the unillustrated functions are arranged. The identification of the various codes is relatively arbitrary, although it is expedient to segregate the different codes as is shown in FIG. 10A, based on the first character. For example, codes 2, 4 and 6 could all begin with a minus pulse (−), code 2 is −, code 4 is −/+ and code 6 is −/+/− or vice versa. Assuming that neither of the codes are selected, functions F41 and F42 are performed to run the vital driver for a fixed period, reconnect the receiver and return.

On the other hand, assuming that one of the codes 2, 4 or 6 had been selected, then function F43 is performed to turn on the minus pulse, i.e. enable the minus pulse generator. Functions F44 through F61 illustrate a significant advantage of the invention over prior art relay systems, especially in the use of the microprocessor's ability for precise timing. Functions F44–F46 provide a timing loop which will occupy 75 milliseconds so long as the pulse being received from the associated T/R is at least this long. If the received pulse is not this long, then an exit from the loop is taken to function F47 wherein the minus pulse generator is disabled and functions F48 and F49 are performed. This is done here (and other places) to allow for energy stored in inductance of rails to dissipate before connecting the receiver. Accordingly, if the received pulse is less than 75 milliseconds long the transmitted pulse will likewise be of approximately of the same duration. Functions F48 and F49 provide the terminating functions of running the vital driver and reconnecting the receiver.

On the other hand if the received pulse is 75 milliseconds or longer, then some or all of functions F51 through F58 are performed for the approach detection function. Approach detection is based on the current level sensed during the transmission process, approaching vehicles in reducing the impedance of the track rails, raise the resulting current level. Function F50 thus checks to see if an approach has been detected. If not, functions F52 and F53 are performed to clear the first approach flag and clear the approach output, to indicate the lack of an approach condition. On the other hand, if an approach pulse is seen, function F51 sets the approach output and functions F54 and F55 set the first approach flag if this is the first approach pulse. If it is not, function F56 checks if the local relays are down, as they should be if an approaching vehicle has previously been detected. If the local relays are down, function F57 sets the local stick flag, which as will be recalled is checked in the executive. If the local relays are not yet down function F57 is skipped but functions F52 and F53 are executed.

After completing the approach processing, function F58 (FIG. 10B) is performed to run the vital driver for another fixed period of time and function F59 checks to see if the received pulse is still present. If it is, function F60 is run for 5 milliseconds and the loop of functions F59 and F60 are performed until the received pulse is no longer present. As a result of this processing the transmitted pulse will be 250 milliseconds long (the nominal duration) if the received pulse is longer than 75 milliseconds but less than 250 milliseconds. If the received pulse is longer than 250 milliseconds the transmitted pulses' duration will be of identical duration with a very small tolerance. When the received pulse is no longer present then function F61 is performed to turn off the minus pulse generator. Function F62 then checks to see whether a code 4 or 6 had been selected. If not functions F63, F75 and F76 are performed; the terminating functions. If a code 4 or 6 had been selected then a second pulse is necessary and functions F65 through F67 provide for the second pulse. As will be seen from the flow chart, the second pulse is of a standard 250 millisecond duration. Function F68 is then performed to determine if a code 6 had been selected, if not function F69, F75 and F76 are performed. If a code 6 had been selected then a third negative pulse is required which is provided by functions F71 through F73 much in the same manner as functions F65–F67 provided for the second pulse. Function F76 calls RCVTST which is used to verify proper operation of the receiver. If the receiver is operating properly the subroutine returns where function F75 terminates the transmit processing.

The receive test subroutine is called in the transmit subroutine to take advantage of the fact that the transmit subroutine has opened a switch in the conductor 61 so that the receiver is partially configured for checking. Since the same condition at the receiver exists during running of STICK and HEAD, if desired (and as implemented in an embodiment of the invention which has been constructed) RCVTST can also be called in those subroutines as well. The specific processing effected by RCVTST is shown in flow diagram fashion in FIG. 15. Briefly, the processing provides for energization of one of the check windings and senses the condition of the associated level detectors (that is level detectors 68 and 69 are associated with winding 62 or check winding #1, and level detectors 70 and 71 are associated with check winding #2, conductor 63). Proper operation is indicated by tripping of the vital level detector and non-tripping of the other level detector in the pair. Accordingly, for example function FT1 turns on the check winding #1. To allow time for the circuitry to sense the change in MMF, function FT2 runs the vital driver for 65 milliseconds. Thereafter, functions FT3 and FT4 check the level detectors 68 and 69, as explained level detector 68 (REC CHECK +) should be tripped whereas level detector 69 (REC +) should not. If this is not the condition of the level detectors then processing is halted with effects already explained. However, assuming that the level detectors are in an appropriate condition indicative of proper operation, then function FT5 stores the input as a check word and function FT6 turns off the check winding #1. Functions FT7 through FT12 perform the same operations for the other check winding.

At this point the presence of functions FT2 and FT8 will be discussed. As mentioned previously, in one embodiment of the invention the vital driver subroutine must be run sufficiently often (for example at least once every 50 milliseconds), otherwise the output of tuned vital driver 26 will decay preventing enablement of the pulse generators and/or dropping all the output relays. In order to ensure that the vital driver subroutine is run sufficiently often, functions such as FT2 and FT8 are strategically located within the processing of FIG. 15. Thus, FIG. 15 is exemplary and similar functions are actually strategically located in the other processing routines (FIGS. 9A–15, although not explicitely illustrated). Those skilled in the art should understand that the 50 millisecond requirement is only an example, and depending on the periodicity of the signals being processed and the delay which can be tolerated in determining misoperation, the 50 millisecond parameter can be varied. Furthermore, based on the particular processor being used as well as on the operating times of the various instructions used to effect appropriate processing sequences, those skilled in the art will be able to locate functions such as FT2 and FT8 at appropriate locations to provide the vital driver subroutine output to maintain the output voltage of the tuned vital driver 26, or their equivalents.

FIG. 15 also illustrates, in functions FT5 and FT11 the process of storing machine state parameters as check words. By strategically locating corresponding functions in other of the subroutines (FIGS. 9A–14) the check word tables built up as a result of storing such check words provide a road map or history of the processing operation. As discussed, periodically the check word tables so created are run through a signature analysis, preparatory to running the vital driver subroutines. The residue of that signature analysis is therefore indicative of the proper operation of the substantitive processing reflected by the particular check words found in the table. As explained below, those residues are used to charge software counters, and the vital driver subroutines actually manipulate those software counters. Since the vital driver subroutine also tests for the appropriate relation between software counters, the two conditions for enabling the proper output frequency of the vital driver subroutines, i.e. proper relationship between the software counters and a non-zero count therein, can only be reflected by continued processing and storage of appropriate check words is a consequence of that processing.

Figure 11A:
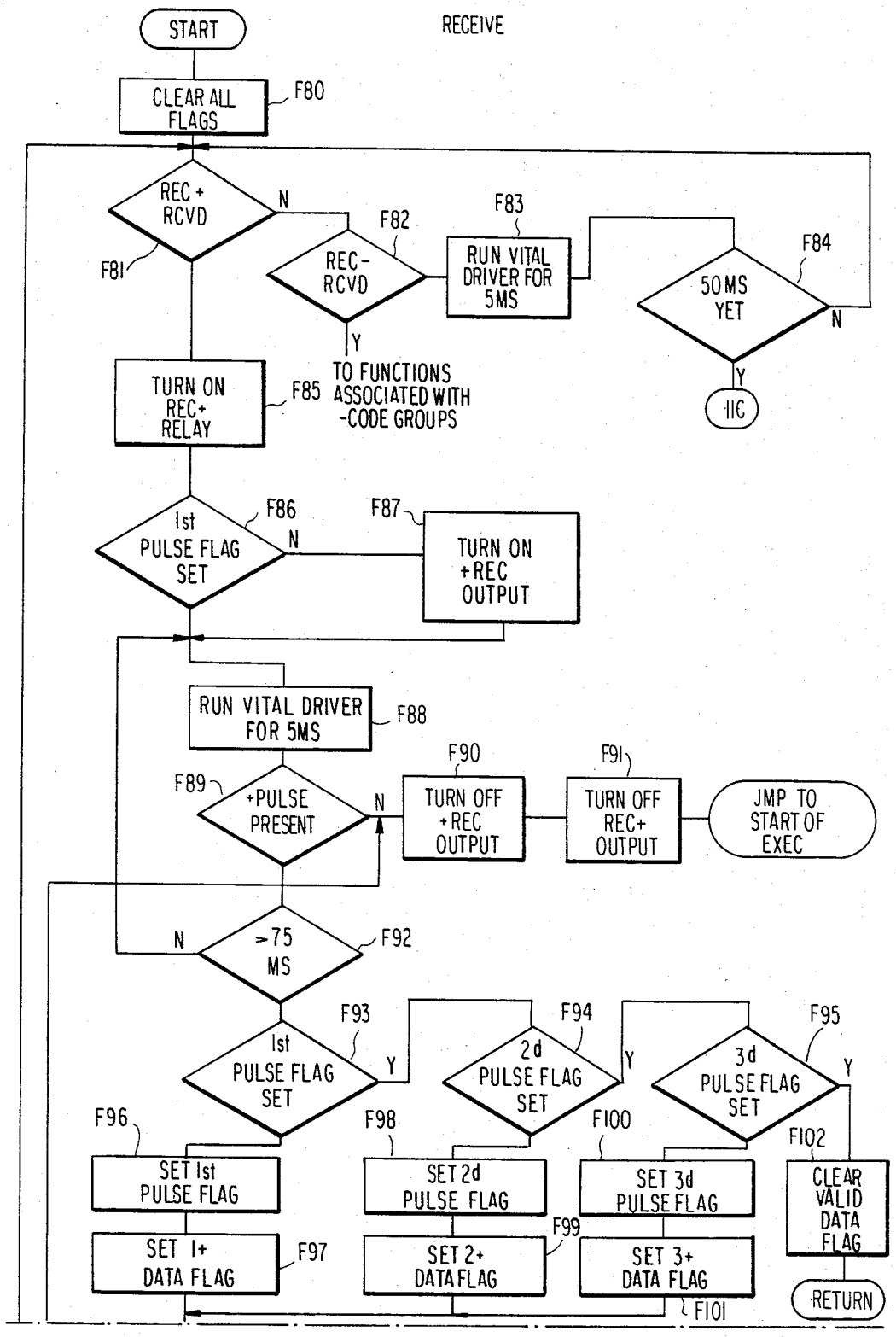
Figure 11B:
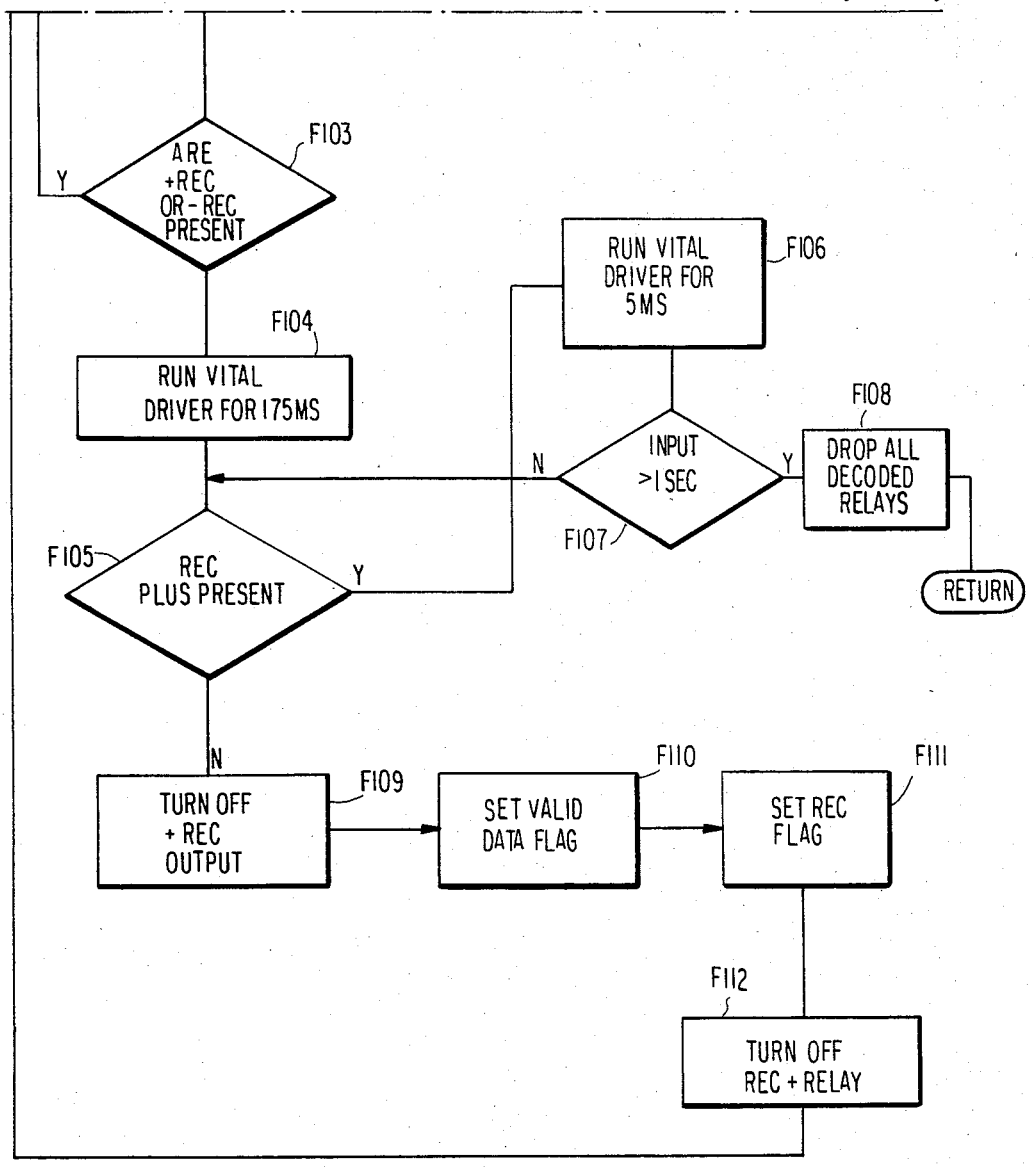

The receive subroutine is shown in FIGS. 11A–11C. This subroutine is called via the executive when a received pulse is detected. The first function, F80 clears all flags, the flags used in this subroutine include valid data, pulse counting flags, i.e. first pulse, second pulse and third pulse, and data flags 1+, 1−, 2+, 2−, 3+ and 3−. At function F81 and F82 a determination is made as to whether a positive or a negative pulse is seen. Functions F83 and F84 complete a loop in which the vital driver is run for a predetermined period (5 milliseconds) and prior to the expiration of 50 milliseconds the presence of another pulse is checked for. On the entry into receive for the first pulse, functions F81 or F82 initially terminate the loop, but after processing the first received pulse, subsequent pulses are checked for in the loop, and if no pulse is seen for 50 milliseconds a branch is made at F84 to complete processing for the received information.

If the received pulse is a positive pulse the exit from the loop is via F81 whereas if the pulse is a negative pulse the exit is via F82. FIG. 11A shows processing for a positive pulse, the processing for a negative pulse is similar.

When a positive pulse is detected, function F85 turns on the REC+ relay output. This can be used to pick a pulse following relay (the presence of this relay is optional). Thereafter, function F86 checks to see if the first pulse flag is set. If it is not, function F87 turns on the +REC output. This output is used as a trigger pulse in the associated T/R (i.e. the T/R on the other side of the insulated joint, at a double intermediate). Therafter, function F88 runs the vital driver sub-routine for a predetermined period of time and function F89 checks to see if a positive pulse is still present. If not, functions F90 and F91 are performed to turn off the +REC output and REC+ relay. Assuming the received positive pulse is still present, then function F92 checks to see whether it has been present for as long as 75 milliseconds. If not, functions F88 and F89 are performed until the pulse duration exceeds 75 milliseconds. Thereafter, function F93 checks to see if the first pulse flag is set. If it is, functions F94 and F95 check to see if the second and third pulse flags are set. If both flags are set (meaning that three pulses had previously been received), then function F102 is performed to clear the valid data flag, since this is the fourth pulse, representing an invalid code.

Depending on which of the pulse flags is not set, a pair of functions F96, F97 or F98, F99 or F100, F101 are performed to set the appropriate pulse flag and the data flag. Those skilled in the art will understand that functions F97, F99 and F101 control the plus data flags, whereas the processing for a negative received pulse corresponding to these functions sets a negative data flag. Function F103 (FIG. 11B) then checks to see whether or not a pulse is being received in the associated T/R (on the opposite side of the joint). If a pulse is being received, an error condition is noted and functions F90 and F91 are performed. Assuming that a pulse is not being received, function F104 runs the vital driver for some length of time, nominally 175 milliseconds and function F105 checks to see if the received pulse is still present. A loop of functions F105–107 is run until either the received pulse terminates, or the received pulse duration exceeds one second. In the latter event, an error condition is assumed and function F108 is performed to drop all the output relays. Assuming however that the pulse duration is less than a second, then function F109 is performed to turn off the +REC output, function F110 sets the valid data flag, function F111 sets a receive flag, function F112 turns off the REC+ relay and processing returns to F81 to look for a second pulse. If one is received within 50 milliseconds, similar processing is effected. If the delay between the end of one pulse and the beginning of the next exceeds 50 milliseconds processing skips to function F113 (see FIG. 11C). The processing for negative pulses returns to the main subroutine at function F113 as well. Function F113 checks to see if the valid data flag is set. If not, the routine terminates with functions F128–130, which will be discussed below. Assuming the valid data flag is set then function F114 checks to see if the new data equals the old data. Briefly, an identical code must be received twice in succession before it will be considered valid and thus a comparison is made at F114, comparing the code being analyzed (NEW) with that previously received (MID) and that actually used in the output relays (OLD). If NEW and MID are different, then it indicates that a code had only been received once and therefore F115 writes the contents of NEW into MID. If the same code is received again, when function F114 is performed the exit to F116 will be taken. Assuming that NEW and MID are identical, then function F116–F118 checks that one and only one data flag is set for the first bit position. If the 1+ and 1− flags are set or if no flag is set, an error is detected and the processing halts. If the 1+ flag is set, function F119 is performed to set the plus relay output. The processing for the 1− flag is not shown although it is similar, as will be apparent from a review of the remaining portion of FIG. 11C. Function F120 determines if the 2+ flag is set (since this leg of the subroutine had the 1+ flag set, the 2+ flag should not be set, if it is a return is effected). Assuming that the 2− flag is not set, then function F122 sets the +REC flag (the use of which will be come clear hereinafter) and the subroutine terminates at functions F128–F130. Assuming that the 2− flag is set, then function F124 sets the +/− relay output. Similar processing is effected at functions F125–F127. The relay output that was set last is then transferred to an output port. Only one code group relay can be energized at one time.

In concluding the subroutine, F128 checks to see if the T/R is a driver. If it is, function F129 is skipped, if it is not a driver, then the rate timer is reset by function F129. Thereafter, function 130 performed to perform a I/O port check. One example of a port check is shown in FIG. 11B of U.S. Pat. No. 4,090,173, another example is found in Sibley application Ser. No. 273,299 filed June 15, 1981, both assigned to the assignee of this application. Basically, the port check compares the condition of the output port with the registers that should be controlling it, to ensure that the port is actually under control of the appropriate regsiters. If the port check is failed, then a halt condition is entered, otherwise control returns to the executive.

Figure 12:
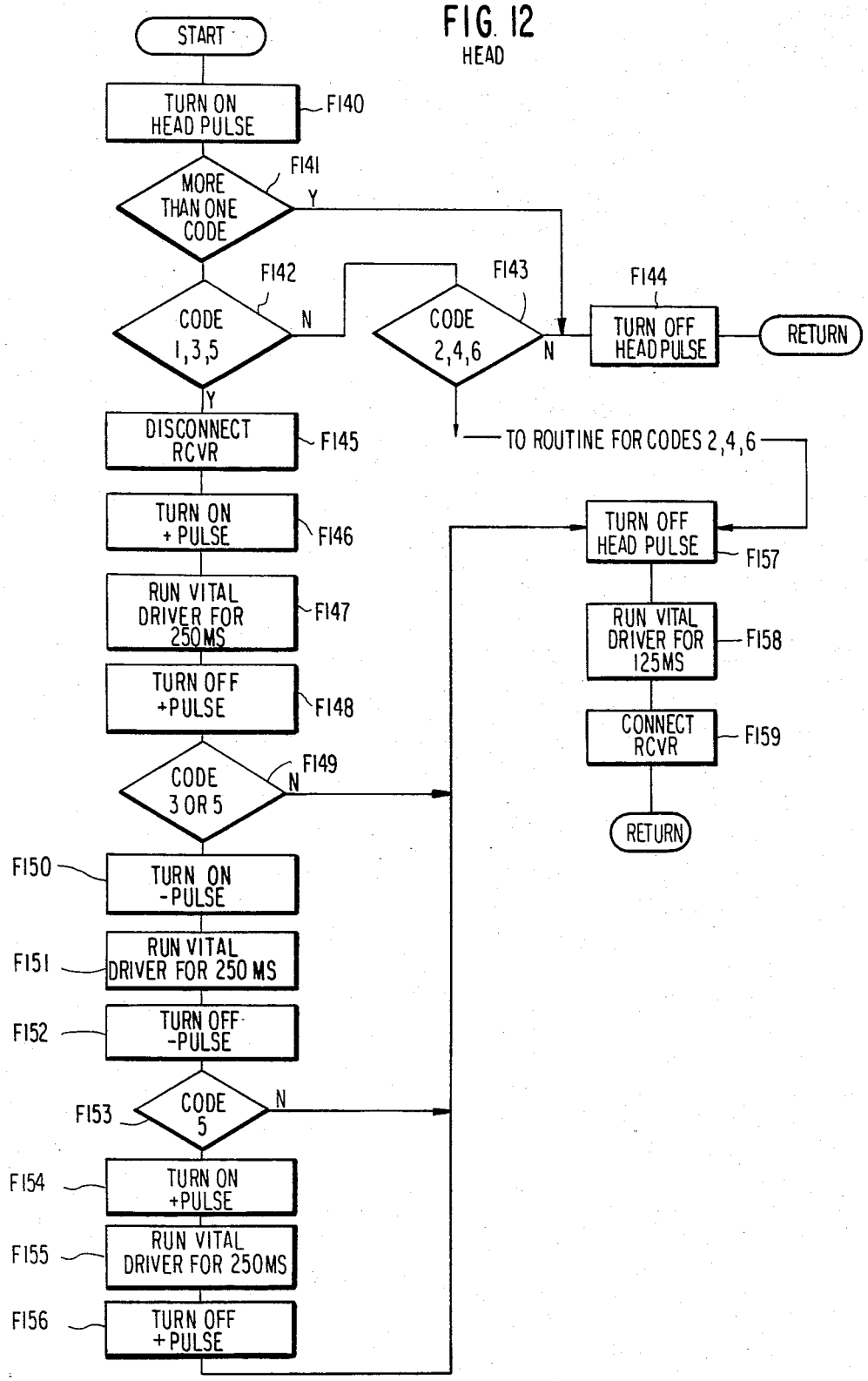

The head subroutine is shown in FIG. 12, and it is called by the executive (F28) at a driver, when the rate timer has expired, or at a follower, either on receipt of a pulse or when the rate timer has expired. The routine itself is a simplified version of the transmit routine. Function F140 turns on the head pulse which is necessary to detecting a selected code, i.e. the head pulse enables the personalization code selecting inputs or the code selection relay inputs. Function 141 checks to see if more than one code has been selected. This code selected may either be personalized (at the head driver) or be a function of the relay output, and is input at port 3 (see FIG. 4B). If more than one code is selected, an error condition is detected, function 144 is performed to turn off the head pulse and return to the calling routine.

Assuming, however, that only a single code is selected, functions F142 and F143 determine which code had been selected. The processing shown in FIG. 12 is for a code 1, 3 or 5, the processing for codes 2, 4 and 6 are similar.

Assuming the selected code is one of 1, 3 or 5, function F145 disconnects the receiver preparatory to transmitting for reasons already explained. Functions F146–148 provide the energization to the plus pulse generator for 250 milliseconds. Function F149 determines whether or not this has completed the transmission (true for code 1, false for codes 3 and 5). Functions 150–152 handle the second pulse (if necessary) and functions 154–156 handle the third pulse (if necessary). Following transmission of the code, function 157 turns off the head pulse, function F158 runs the vital driver for 125 milliseconds. This corresponds to the transfer delay, allowing the currents in the rail to die out before the receiver is reconnected. Reconnecting the receiver is effected by function F159. That concludes the discussion of head processing. It should be understood that RCVTST may also be called from the head routine, as already explained.

Figure 13A:
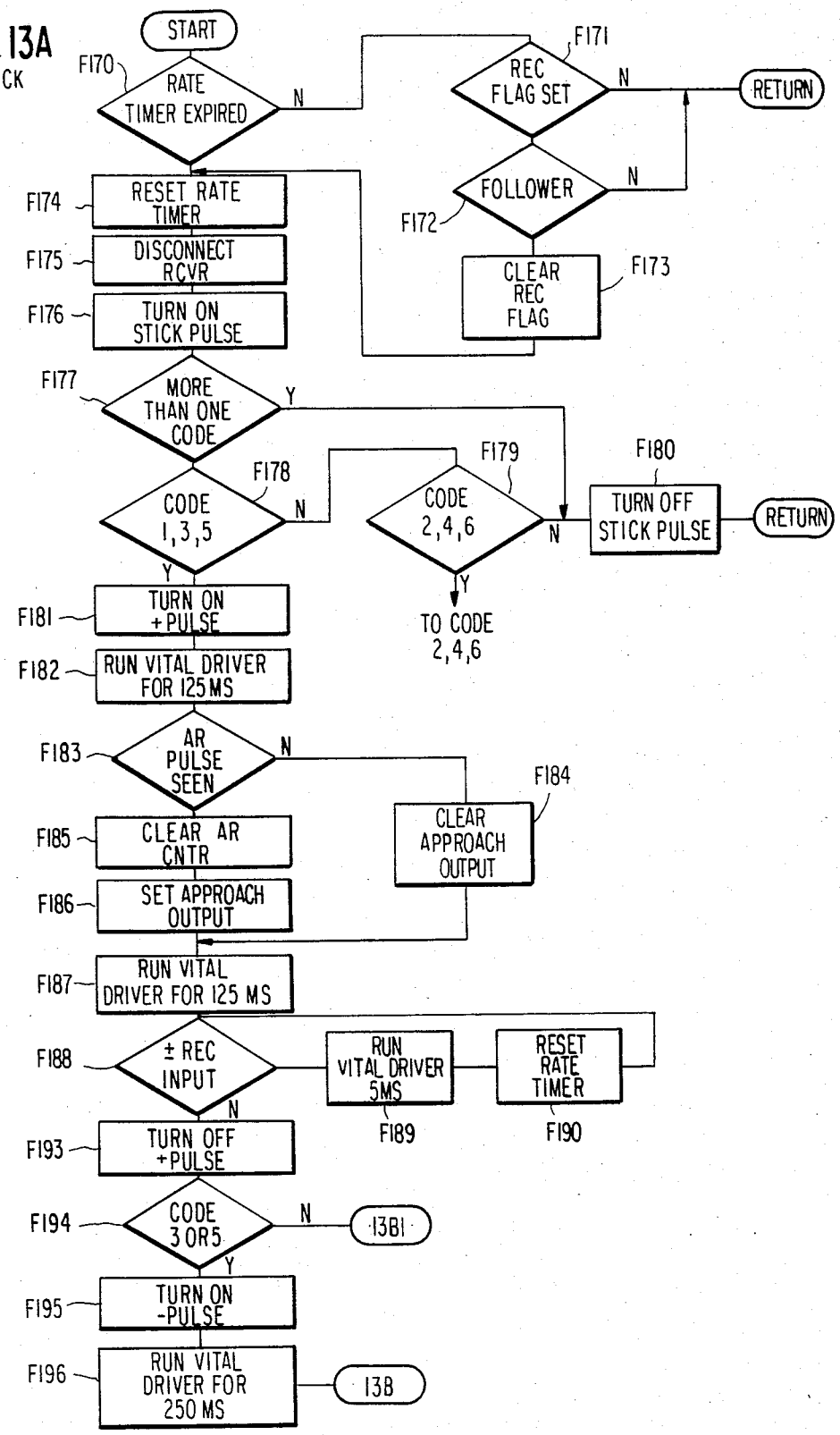
Figure 13B:
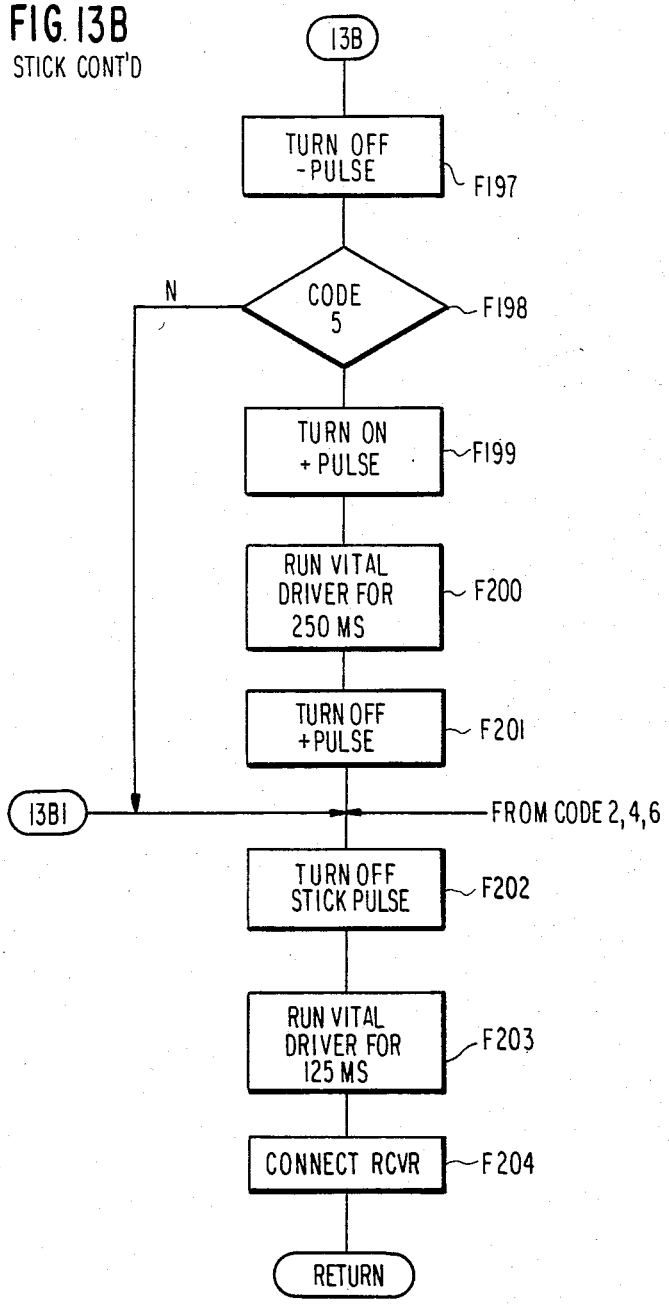

The stick subroutine is shown in FIGS. 13A and 13B, and is called by the executive if the local stick flag is set. The local stick flag is set in the transmit subroutine if two approach pulses are received with the local relays down. The local stick flag is cleared in the executive. The stick function is used to allow for following moves; for example if an eastbound train is seen approaching at a location the stick flag will be set. When the train passes the location, the stick function enables the T/R whose stick flag is set to transmit behind the train in a direction opposite to its direction of travel to provide for code for following vehicles. In the absence of the stick function, no following vehicle could receive code and thus could not proceed until the first vehicle had passed the limits of the controlled territory. Accordingly, the stick function is also similar to the transmit subroutine in that it provides code to the rails. Furthermore, the stick function is only pertinent at an intermediate; intermediates are also personalized to be either head stick or follower stick. Referring now to FIG. 13A, functions F170–173 determine if a stick function based transmission is to be effected. As shown, a transmission will be effected if the rate timer has expired (the routine is only entered if the stick flag is set) or if the intermediate is a follower intermediate and a received pulse is detected. Accordingly, if the rate timer has not expired, function F171 checks to see if the receive flag is set. If so, function F172 checks to see if this is a follower, and if it is function F173 is performed to clear the receive flag. On the other hand, if a receive flag is not set or if the intermediate is not a follower then that concludes the processing.

Accordingly, at an intermediate where the stick function is set and either the rate timer is expired or the unit is a follower and a pulse has been received, function F174 is performed to reset the rate timer, function F175 disconnects the receiver preparatory to transmitting. Function F176 turns on the stick pulse which is used for a purpose similar to the head pulse. Thereafter functions F177–F180 are performed which are similar to the head subroutine functions F141–F144.

Assuming only one code is selected, and it is a code 1, 3 or 5, then function F181 is performed to turn on the plus pulse generator; the function is timed by a function F182. Function F183 determines if an approach pulse is seen. If not, function F184 clears the approach output, if an approach pulse is seen function F185 clears the approach counter and function F186 sets the approach output. The approach counter cleared by function F185 is used by the executive to determine if more than 8 seconds has expired since the last transmission has been effected. Function F187 runs the vital driver for 125 milliseconds to complete the 250 millisecond pulse. Function F188 checks to see if there is a +REC or −REC input (this is the input from the associated T/R on the other side of the joint). If there is, function 189 runs the vital driver for a short period (for example 5 milliseconds) and function 190 resets the rate timer. The loop of functions 188–190 is repeated until the ± REC input disappears.

Assuming there is no +REC or −REC input, function F193 turns off the pulse generator. Thereafter, function F194 checks the code selected, for example if a code 1 then a single transmission is all that is necessary, otherwise additional pulses may be necessary. If a second pulse is necessary, functions F195–197 (see FIG. 13B) provide the second pulse, and if a third pulse is required functions F199–F201 are provided. Functions F202–F204 terminate the subroutine by turning off the stick pulse, running the vital driver for 125 milliseconds, effecting the transfer delay and reconnecting the receiver.

Figure 14:
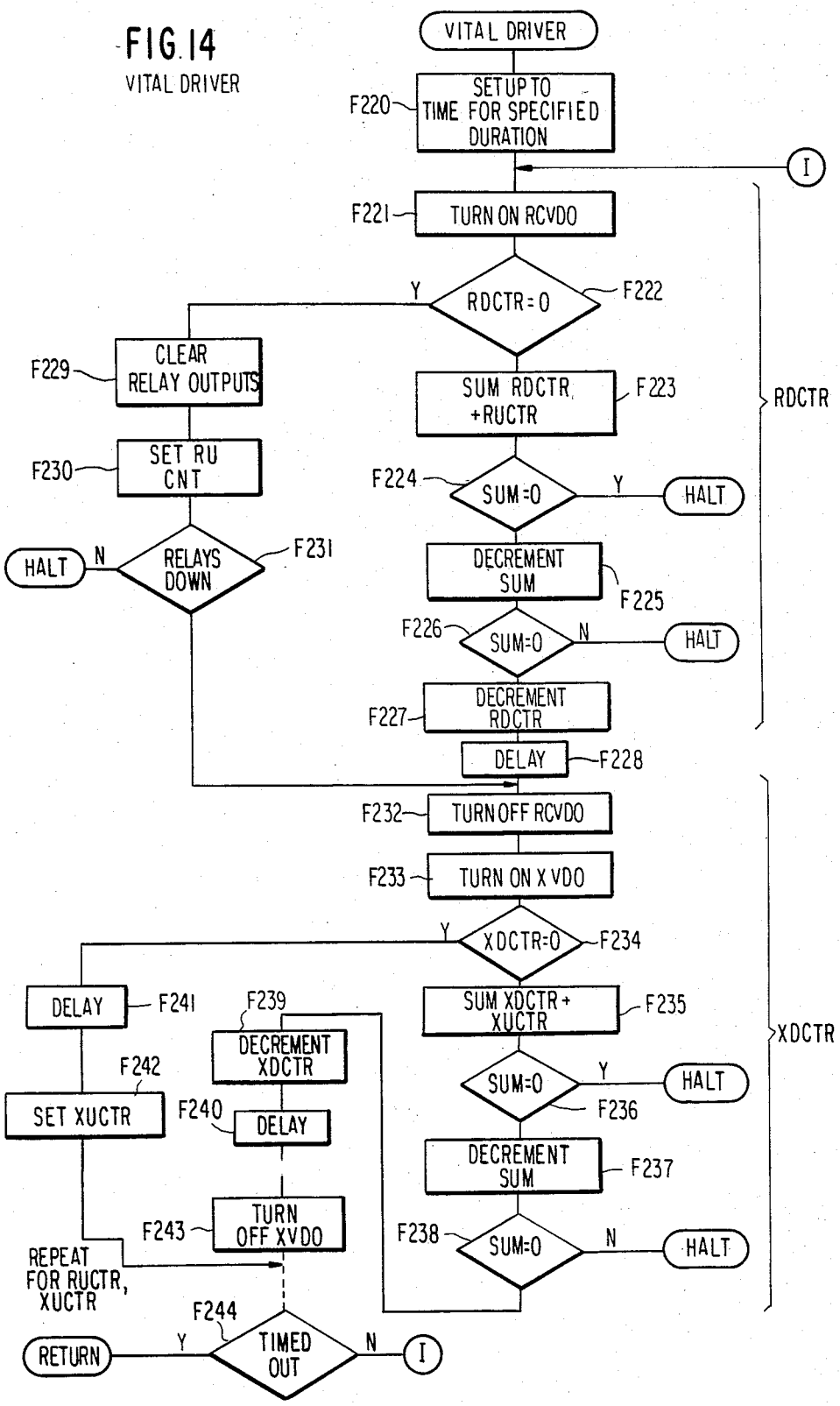
Figure 15:
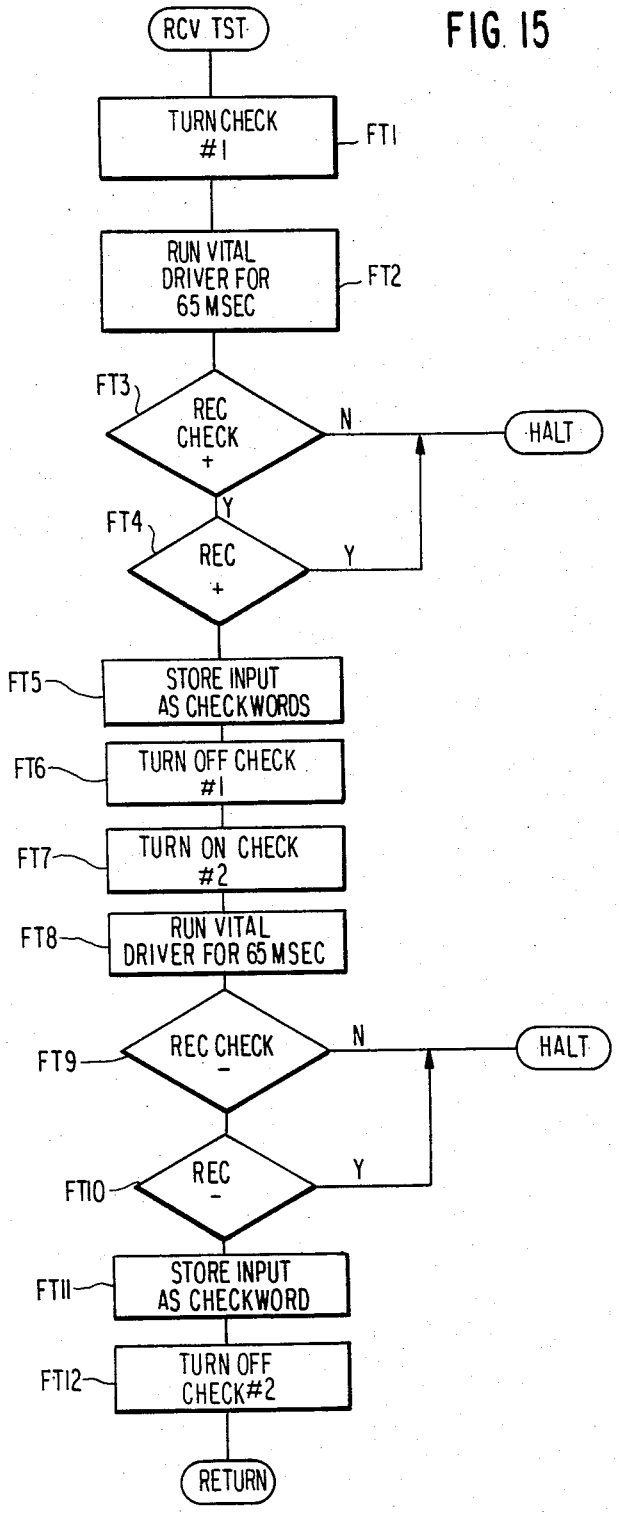

At various points in the previous discussion mention had been made of the vital driver sub-routine, a flow chart of the vital driver sub-routine is shown in FIG. 14. This is an adaptation of a technique in prior U.S. Pat. No. 4,181,849, assigned to the assignee of this application. The vital driver sub-routine is the routine which is used to check for proper operation of the other routines, and to make sure that the check is effected periodically before allowing a CPU to provide an output to the outside world.

At various points in the substantitive processing of other subroutines check words are stored in fixed locations Although this is not explicitly shown, instructions to store check words may be located at various decision points so as to leave a trail, in the check word table, of the path taken through the logic. Different check words are stored depending on the path taken through the logic, these check words are derived from the state of the various flags and registers used in the substantive processing. Following substantitive processing, a signature analysis is performed on the check words so stored; for example a CRC, BCH or polynomial check in which the check words are processed to produce a residue. The residue is used to reload three software counters, when that is effected, the storage locations are cleared and rewritten with fixed data; for example a halt or a stop instruction is used. The contents of these same locations (now containing the fixed data) is again signature analyzed to produce a further residue which is used to load a fourth software counter. Thus in order to properly load all four counters, the proper check words must be derived, and then the area in which the check words are stored must be cleared (in the absence of the last function the fourth software counter can not be loaded). Proper loading of the fourth software counter thus ensures that the data used to load the first three is destroyed, so that if the first three software counters must again be reloaded, the data must be reconstituted by continued future functioning of the CPU and appropriate signature analysis.

The four software counters referred to above comprise a receive vital driver up counter, receive vital driver down counter, and the transmit counters, up and down. The vital driver sub-routine shown in FIG. 14 increments the up counter and decrements the down counter, checks to see that they maintain a proper relationship and are non-zero. The proper relationship is indicative of proper functioning of the substantitive processing which results in the check words used to initially load these counters, and the non-zero contents are proof that the processing is being effected periodically at a sufficient rate so that the information represented in the registers of the CPU is not "stale".

In the event that the quantity in the counters do not maintain the appropriate relationship, a halt state is entered, the counters are incremented or decremented to a predetermined or zero condition, and the associated function (picking output relays for the receive function or enabling transmission for the transmit function) is inhibited.

In an embodiment of the invention which has actually been constructed, the up and down counters must maintain a relationship so that the contents of one of the counters is two more than the complement of the other. The vital driver sub-routine shown in FIG. 14 is made up of four sections, each of which manipulates one of the four counters. Because the counters are manipulated one at a time, the required relationship between the counters changes as the vital driver sub-routine is run, and thus the test is different in each of the four sections. Referring now to FIG. 14, function F220 sets up to time for a specified duration, the sub-routine is entered with this information. Reference to other processing routines indicates that the substantitive processing determines the amount of time during which the vital driver will be run, and function F220 sets a timer for the specified duration, the status of the timer will be checked in the course of running the vital driver sub-routine. Function F221 is the first step in manipulating the first software counter (associated with the receive function) and thus it turns on the receive vital driver output (RCVDO). Function F222 checks to see if the receive down counter (RDCTR) is equal to zero. If it is, function F229 is performed to clear the relay outputs. Accordingly, the decoded outputs of a T/R can not be maintained in the event the contents of the counter are counted down to zero. This requires the counter to be periodically reset. In that condition, function F230 sets the up counter, function F231 checks to ensure that the relays are down. If they are not the machine goes into a halt state. Assuming that the receive down counter is not zero then function F223 sums the up and down counter for the receive function. Function F224 checks to see if the sum is zero, if it is an error condition is detected and another halt state is entered. Assuming the sum is not zero, function F225 decrements the sum and function F226 again checks it. At this point the sum should be zero and therefore if it is not, another halt state is entered. Assuming the sum is zero, function F227 decrements the down counter, function F228 provides for a predetermined delay, and function F232 turns off the receive vital driver output. The receive vital driver output, assuming proper operation, is turned on and off at a predetermined rate to enable the receive vital driver. Functions F234–243 perform similar functions for the transmit down counter(XDCTR). A significant difference between the transmit and receive functions is that a zero quantity in the transmit counters bypasses function 243, however since the significant output is alternating, steady on or off at the transmit vital driver output (XVDO) is quite safe. Following function F243, the receive up counter is manipulated in a manner similar to that shown in functions F222–F233, and following that processing, the transmit up counter is manipulated in a fashion similar to functions F233–F243. At the conclusion of that manipulation, function F244 is performed to check to see if the timer set at function F220 has timed out. If not, processing returns to F221, if it has, a return is made to the calling routine.

In view of the preceding discussion, and with reference to FIGS. 4A–4C, operation of the CPU 25 should be apparent. In particular, as shown in FIG. 4A, the CPU includes a microprocessor chip 50 which can be any of a variety of commercially available devices coupled to a bidirectional bus 56 to which is also coupled ROM 51, RAM 52, the three mentioned counters 53 and a plurality of I/O ports (1–14 are illustrated). Operation of the vital driver sub-routines produces transmit (XVDO) and receive vital driver signals (RVDO), one from the microprocessor chip 50, and the other from port 2 (it is of course understood that the particular location from which any of the signals shown in FIGS. 4A–4C are derived can be readily varied from that which is shown). So long as the processor is operating properly, these signals have a predetermined frequency characteristic to which the transmit and receiver vital drivers in the vital driver 26 are tuned. As a result, so long as the two tuned vital drivers receive the appropriate input, they produce the appropriate DC potential on their output for enabling the output relays and the transmit pulse generators. Absence of the appropriate frequency input, or shifting or drifting in the frequency thereof will of course reduce the output of the vital drivers 26 and prevent picking or holding of the output relays or enablement of the pulse generators. Input port 1 is coupled to the serial/parallel shift register 57. The serial input to this shift register is provided by a CPU 25 associated with a different transmitter/receiver (connected on the other side of the insulated joint) from the transmitter/receiver in which the CPU 25 under discussion. is located. Accordingly, stick enable messages can be received at the CPU 25 via the shift register 57. For I/O port testing purposes, the processor 50 is arranged to, after serial receipt of such a message to control the shift register 57 to operate in a parallel mode and to read in, at its parallel inputs, fixed data. Comparing the fixed data read in with the serially received data from the other CPU 25 allows verification that the shift register 57 is operating properly and the data so received can be acted on. To further enable the port testing function, input port 3 is coupled with an output port 4 for testing purposes, i.e. the CPU 25 can test its own port 3 by placing a predetermined bit pattern in port 4 and then reading port 3 (reference has already been made to the details of such port testing operations). Similar relationships exist between input port 5 and output port 6, input port 7 and output port 8, output port 9 and input port 10, output port 11 and input port 12, and output port 13 and input port 14. In each case the first port is the active port in that through it pass signals necessary to operation of the CPU 25 or the results of that processing, the second named port is used in checking, testing or verifying that the first named port is operating properly.

Both input ports 5 and 7 are connected to a receiver, however, one receiver (connected to port 7) is in the same transmitter/receiver as is the CPU in which the port exists, whereas the other (connected to port 5) is connected to the associated CPU 25.

In view of the foregoing discussion, the operation of the CPU 25 as illustrated in FIGS. 4A–4C should be apparent to those skilled in the art.

We claim:

1. A railroad track circuit comprising a transmitter and a receiver spaced apart along a section of railroad track, in which said transmitter comprises:

a source of electrical energy and means coupling said source of electrical energy to said section of railroad track, and in which said receiver comprises:

microprocessor means with at least one input port and at least one output port for producing signals at said output port in response to signals at said input port, means connecting said input port to said section of track at a location spaced from said means coupling said source of electrical energy, output means for driving an indication device coupled to said output port, whereby said output means is capable of controlling an indication device to indicate the occupancy condition of said section of track between said transmitter and said receiver.

2. The apparatus of claim 1 in which said means connecting said input port to said section of track comprises:

a toroid, a conductor connected across said track and magnetically coupled to said toroid, a linear Hall sensor located in a gap in said toroid, receiver signal processing means coupled to said input port, including at least one digital lever detector, for providing one or another signal representative of current in said track above or below a threshold.

3. The apparatus of claim 1 in which said microprocessor means includes:

a microprocessor, vital driver means responsive to selected frequency signals from said microprocessor for producing electrical energy on selected conductors, means coupling said electrical energy on at least one of said selected conductors to energize said output means, said microprocessor further including logic means for determining an occupancy condition of said section of track and arranged to require predetermined signal characteristics extending over a significant time duration for providing a lack of occupancy indication.

4. The apparatus of claim 1 wherein: said transmitter includes control means for chopping said source of electrical energy to produce pulses of a controlled duration and wherein said microprocessor means includes:

a microprocessor, vital driver means responsive to selected frequency signals from said microprocessor for producing electrical energy on selected conductors, means coupling said electrical energy on at least one of said selected conductors to energize said output means, said microprocessor further including logic means for providing a lack of occupancy indication only in response to receipt of signals over a time duration longer than said controlled duration.

5. The apparatus of claim 1 wherein: said transmitter includes control means for coupling said energy to said track as a pulse group of one or more pulses of either polarity, and said microprocessor means includes a microprocessor, vital driver means responsive to selected frequency signals from said microprocessor for producing electrical energy on selected conductors, means coupling said electrical energy on at least one of said selected conductors to energize said output means, said microprocessor further including logic means for providing a lack of occupancy indication only in the event that a pulse group is received which is identical to an immediately prior received pulse group.

6. The apparatus of claim 5 in which:

said source of electrical energy comprises a pair of controlled code pulse converters, one for each polarity of current flow, and in which said control means includes a code pulse selection means for selecting among a predetermined vocabulary of pulse groups, and in which said logic means requires a fixed number of sequentially received pulse groups before providing a lack of occupancy condition.

7. The apparatus of claim 2 in which said means connecting said input port to said section of track further includes:

a source of check MMF, said receiver signal processing means includes a pair of level detectors, a check level detector with a threshold lower than another level detector, and in which said microprocessor means includes:

means to open circuit said conductor magnetically coupled to said toroid, means to energize said source of check MMF, and means to halt microprocessor operation unless said pair of level detectors have different, predetermined outputs.

8. The apparatus of claim 1 in which said microprocessor means includes:

a microprocessor, vital driver means responsive to selected frequency signals from said microprocessor for producing electrical energy on selected conductors, and means coupling said electrical energy on at least one of said selected conductors to energize said output means.

9. The apparatus of claim 8 wherein said source of electrical energy comprises a pair of controlled code pulse converters, one for each polarity of current flow, each of said code pulse converters energized by said selected conductors and control means for coupling said energy to said section of railroad track as a pulse group of one or more pulses of either polarity, including a code pulse selection means for selecting among a predetermined vocabularly of pulse groups.

10. The apparatus of claim 9 in which said control means includes first and second output conductors coupling said code pulse converters to said section of railroad track, and each of said code pulse converters includes:

a first transformer, switching means for providing for current flow in a primary of said first transformer of alternating polarity at a controlled rate, a pair of controlled rectifiers connecting different terminals of a secondary of said first transformer to said first output conductor, a different terminal of said secondary of said first transformer coupled to said second output conductor.

11. The apparatus of claim 10 in which said switching means includes a timing circuit, a push-pull amplifier coupled between said timing circuit and two terminals of a primary of a second transformer, and a power amplifier coupled between a secondary of said second transformer and said primary of said first transformer.

12. The apparatus of claim 8 in which said microprocessor means further includes:

receiver means coupled to said section of railroad track and to said microprocessor for indicating to said microprocessor condition and level of current flow in said section of railroad track.

13. The apparatus of claim 12 in which said receiver means includes self-test means controlled by said microprocessor for indicating to said microprocessor an operating condition of said receiver means.

14. The apparatus of claim 1 in which said means coupling said source of electrical energy to said section of railroad track comprises:

a pair of code pulses converters, one for each of polarity of current flow, each coupled to said section of railroad track, microprocessor means for controlling each of said code pulse converters to drive said section of railroad with a pulse group consisting of one or more pulses of controlled duration with alternating polarity.

15. The apparatus of claim 14 in which said means coupling said source of electrical energy to said section of railroad track further includes first and second output conductors coupling said code pulse converters to said section of railroad track, and each of said code pulse converters includes:

a first transformer, switching means for providing for current flow in a primary of said first transformer of alternating polarity at a controlled rate, a pair of controlled rectifiers connecting different terminals of a secondary of said first transformer to said first output conductor, a different terminal of said secondary of said first transformer coupled to said second output conductor.

16. The apparatus of claim 15 in which said switching means includes a timing circuit, a push-pull amplifier coupled between said timing circuit and two terminals of a primary of a second transformer, and a power amplifier coupled between a secondary of said second transformer and said primary of said first transformer.

17. An occupancy detection and communication system for railroads which eliminates the necessity for signalling line wires running parallel to a section of track, comprising:

a plurality of transmitter-receiver pairs, each pair located at a different one of a plurality of insulated joints in a railroad territory and a single transmitter-receiver located at each end of said railroad territory, each said transmitter-receiver comprising:

a microprocessor with plural input and output ports, a pair of pulse generators of different polarity coupled between microprocessor output ports and said track adjacent a transmitter-receiver, a receiver coupled between an input port and said track adjacent a transmitter-receiver, said microprocessor including:

first means responsive to receipt of one or more pulses from said receiver to select a code group output, second means responsive to selection of a code group output to identify said code group output to the other transmitter-receiver of said pair, third means responsive to identification of a code group output by the other of said transmitter-receiver pair to stimulate said pulse generators to transmit a corresponding code group, and driver means responsive to said first means for maintaining a lack of occupancy output only so long as said first means selects a pulse group output within a fixed timing period.

18. The apparatus of claim 17 in which microprocessors in said single transmitter-receiver include:

timing means for timing out a predetermined period, and fourth means responsive to expiration of said timing means stimulating said pulse generators to transmit a predetermined code group.

19. The apparatus of claim 18 in which said microprocessors in said single transmitter-receiver further include:

personality means to identify whether said transmitter-receiver is at one or another end of said section of track to indicate whether or not independent coding is allowed, driver means responsive to said personality means, if independent coding is allowed, to provide a code group selection to said second means, and wherein said timing means includes means responsive to said personality means to select a predetermined period from at least a first and a second, longer period.

20. An occupancy detection and communication system for railroads which eliminates the necessity for signalling line wires running parallel to a section of track. comprising:

a plurality of transmitter-receiver pairs, each pair located at a different one of a plurality of insulated joints in a railroad territory and a single transmitter-receiver located at each end of said railroad territory, each said transmitter-receiver comprising:

a microprocessor with plural input and output ports, a pair of pulse generators of different polarity coupled between microprocessor output ports and said track adjacent a transmitter-receiver, a receiver coupled between an input port and said track adjacent a transmitter-receiver, a signal connection to an associated microprocessor of a transmitter-receiver pair, at least one output indicator for indicating an occupancy condition of a selected portion of said section of track, each said microprocessor including:

one or more personalization inputs identifying a functional location of the microprocessor as a head, follower or intermediate, an executive routine responsive to signals received by said receiver, to signals from any associated microprocessor and to said personalization inputs for iteratively executing and during such executing for calling one or more subroutines, and a plurality of subroutines for executing transmit, receive, stick or head functions, wherein said receive function provides control of said at least one output indicator.

21. The apparatus of claim 20 which each said transmitter-receiver further includes:

vital driver means responsive to selected frequency signals from said microprocessor for producing electrical energy on selected conductors, and means coupling said electrical energy on at least one of said selected conductors to energize said pulse generators.

22. The apparatus of claim 20 which each said transmitter-receiver further includes:

vital driver means responsive to selected frequency signals from said microprocessor for producing electrical energy on selected conductors, and means coupling said electrical energy on at least one of said selected conductors to energize said at least one output indicator.

23. The apparatus of claim 20 which each said transmitter-receiver further includes:

vital driver means responsive to selected frequency signals from said microprocessor for producing electrical energy on selected conductors, and means coupling said electrical energy on at least one of said selected conductors to energize said at least one output indicator and coupling said electrical energy on at least another of said selected conductors to energize said pulse generators.

* * * * *